US008145351B2

(12) United States Patent
Schininger et al.

(10) Patent No.: US 8,145,351 B2
(45) **Date of Patent: *Mar. 27, 2012**

(54) STORAGE DISPENSER FOR OBJECTS

(75) Inventors: Manfred Schininger, Linz (AT); Claus Peham, Linz (AT); Ernst Schacherl, Linz (AT)

(73) Assignee: KEBA AG, Linz (AT)

( * ) Notice: Subject to any disclaimer, the term of this patent is extended or adjusted under 35 U.S.C. 154(b) by 912 days.

This patent is subject to a terminal disclaimer.

(21) Appl. No.: 11/663,319

(22) PCT Filed: Aug. 26, 2005

(86) PCT No.: PCT/AT2005/000343

§ 371 (c)(1),
(2), (4) Date: Aug. 3, 2007

(87) PCT Pub. No.: WO2006/032067

PCT Pub. Date: Mar. 30, 2006

(65) Prior Publication Data

US 2008/0128444 A1 Jun. 5, 2008

(30) Foreign Application Priority Data

Sep. 21, 2004 (AT) ..... A 1580/2004

(51) Int. Cl.
*G07F 17/00* (2006.01)

(52) U.S. Cl. ..... 700/237; 700/242; 700/243; 700/244; 700/232; 221/2; 221/9; 221/12

(58) Field of Classification Search ..... 700/231, 700/232, 242–244; 221/2, 9, 12
See application file for complete search history.

(56) References Cited

U.S. PATENT DOCUMENTS

| | | | |
|---|---|---|---|
| 4,317,604 | A | 3/1982 | Krakauer |
| 4,828,095 | A | 5/1989 | Kilwin |
| 5,212,649 | A | 5/1993 | Pelletier et al. |

(Continued)

FOREIGN PATENT DOCUMENTS

| | | |
|---|---|---|
| DE | 33 36 565 | 4/1985 |

(Continued)

OTHER PUBLICATIONS

International Search Report.

(Continued)

*Primary Examiner* — Michael K Collins
(74) *Attorney, Agent, or Firm* — Collard & Roe, P.C.

(57) ABSTRACT

The invention relates to a storage machine (1) for objects, comprising a compartment system (4) with a plurality of compartments (3) which are at least partially enclosed by a machine housing (2) or some other surround, and with at least one closure mechanism (7) which can be displaced relative to a central, predefined access orifice (6) in the machine housing (2) to release or prevent access to a specific individual compartment (3) or a specific group of adjacent compartments (3). The storage machine (1) also has at least one drive system for displacing the closure mechanism (7) in a controlled manner and the ability of the closure mechanism (7) to move is dependent on an access right which can be checked by a control system. This storage machine (1) has at least one safety system (28) for affording extensive, increased personal safety with respect to risks posed by automated sequences or with respect to its displacement drives which can be activated automatically.

49 Claims, 8 Drawing Sheets

U.S. PATENT DOCUMENTS

| | | | | |
|---|---|---|---|---|
| 5,385,265 | A | 1/1995 | Schlamp | |
| 5,638,985 | A | 6/1997 | Fitzgerald et al. | |
| 5,730,316 | A * | 3/1998 | Falk | 221/122 |
| 6,142,373 | A | 11/2000 | Claassen | |
| 6,502,718 | B2 | 1/2003 | Fitzgerald et al. | |
| 7,086,198 | B2 | 8/2006 | Hayden | |
| 7,228,200 | B2 | 6/2007 | Baker et al. | |
| 7,395,945 | B2 * | 7/2008 | Godlewski | 221/122 |
| 7,735,680 | B2 * | 6/2010 | Godlewski | 221/122 |
| 7,925,375 | B2 * | 4/2011 | Schininger et al. | 700/214 |
| 2001/0034665 | A1 | 10/2001 | Kinory et al. | |
| 2002/0032501 | A1 | 3/2002 | Tilles et al. | |
| 2002/0035515 | A1 | 3/2002 | Moreno | |
| 2002/0156645 | A1 | 10/2002 | Hansen | |
| 2002/0184497 | A1 | 12/2002 | Gage et al. | |
| 2003/0040980 | A1 | 2/2003 | Nakajima et al. | |
| 2005/0160281 | A1 | 7/2005 | Thibadeau | |

FOREIGN PATENT DOCUMENTS

| | | |
|---|---|---|
| DE | 199 39 744 | 2/2001 |
| DE | 102 46 650 | 4/2004 |
| EP | 0 703 334 | 3/1996 |
| EP | 0 749 101 | 12/1996 |
| EP | 1 403 830 | 3/2004 |
| JP | 03-221014 | 9/1991 |
| JP | 10-188105 | 7/1998 |
| WO | WO 01/43091 | 6/2001 |
| WO | WO 01/78022 | 10/2001 |
| WO | WO 2004/114234 | 12/2004 |
| WO | WO 2005/111954 | 11/2005 |

OTHER PUBLICATIONS

International Preliminary Report on Patentability.
Austrian Search Report for AT 010 547 U1 (Nov. 25, 2008).

* cited by examiner

STORAGE DISPENSER FOR OBJECTS

CROSS REFERENCE TO RELATED APPLICATIONS

Applicants claim priority under 35 U.S.C. §119 of Austrian Application No. A 1580/2004 filed Sep. 21, 2004. Applicants also claim priority under 35 U.S.C. §365 of PCT/AT2005/000343 filed Aug. 26, 2005. The international application under PCT article 21(2) was not published in English.

BACKGROUND OF THE INVENTION

1. Field of the Invention

The invention relates to a machine for storing objects, of the type outlined in the introductory part of claim 1.

2. The Prior Art

Patent specification JP 03-221014 A discloses a machine containing parcels with a plurality of compartments which can be manually closed by individual doors. When a parcel detection sensor of the machine detects a parcel in a compartment, the compartment can be locked or bolted by depressing a lock button. A security sensor is also provided, which detects unauthorized entry of a moving body, such as a child or an animal for example. This security sensor may be provided in the form of an infrared sensor, for example. If a child or animal is detected by this security sensor, an output signal of this sensor prevents a child from being locked in, so that the safety of the machine is increased as regards children. The problem of animals being locked in is also eliminated. This machine does not have doors that are driven and closed automatically.

SUMMARY OF THE INVENTION

The underlying objective of this invention is to propose a storage machine suitable for depositing and retrieving objects for people in general, which is easy and convenient to operate on the basis of automated procedures but which nevertheless ensures a high degree of personal safety with regard to injury due to the automation features.

This objective is achieved by the invention on the basis of a storage machine incorporating the characterizing features specified in claim 1.

The advantage of this approach is that the high degree of automation achieved by the storage machine makes it convenient to use. Furthermore, even more complex sequences can also be run without this leading to misunderstandings or operating mistakes on the part of the user. This is achieved due to the drives of the machine, amongst other things, which can be activated and deactivated on an automated basis. The particular advantage of this is that in spite of the high degree of automation, the risks to which the user or other people around the machine are exposed are particularly low and the storage machine proposed by the invention affords a high degree of personal safety overall. As a result of this high degree of personal safety with respect to potential injury due to the automated sequences of the machine, it may also have a high degree of access security in terms of unauthorized access to the compartments. In particular, as a result of the measures used to increase personal safety, drives and moving elements which are robust, strong and relatively secure in terms of manipulation attempts may be used. This means that a storage machine proposed by the invention may be designed so that it offers both personal safety and in particular secure access. A storage machine proposed by the invention specifically offers high personal safety and access security with virtually no compromises, even though these properties conflict with one another to a certain extent.

An embodiment defined in claim 2 is of advantage because a closing operation of the closure mechanism can be prevented or interrupted as soon as an obstruction is detected in the danger area. In particular, injuries to the hands and fingers of a user can be reliably and effectively prevented, even if the latter get into the risk area monitored by sensors during an ongoing or suddenly initiated closing operation of the closure mechanism, for example due to lack of attention.

An embodiment defined in claim 3 is of advantage because only the region which may be regarded as posing a direct potential risk is monitored, whereas all other zones and surrounding areas can not cause disruptions to the normal operating sequences.

An embodiment defined in claim 4 is also of advantage because an absolutely exact and failsafe object detection system is made possible due to an object recognition system based on software.

The embodiment defined in claim 5 enables an inexpensive yet reliable design to be used for the system used for monitoring the risk and access area of the storage machine.

As a result of the features defined in claim 6, potentially dangerous closing and opening operations of the closure mechanism are either not initiated at all or are interrupted in good time.

A structurally simple yet reliable monitoring system with an exactly defined, limited monitoring zone is defined in claim 7.

A monitoring system which remains fault-free and maintenance-free for long periods and which can be integrated in the machine structure is defined in claim 8.

Also of advantage is an embodiment defined in claim 9, since it enables the use of particularly functionally reliable, electromechanical means, by which the risk of injuries, in particular crushing of the limbs of a careless user, can be easily reduced to a minimum.

An embodiment defined in claim 10 has also proved to be of advantage especially because an automated or manually initiated closing operation of the closure mechanism, in particular a slide element, can not pose a risk to the user or damage to objects. Especially in the case of an automated repeated opening movement of the closure mechanism or an automated backwards movement of the slide element prompted by detection of an obstruction in the closing region or in the displacement zone of the closure mechanism, a body part which might have become lightly trapped between the machine housing and the closure mechanism, such as the wrist, or a jammed object, can be effortlessly released, without any physical or psychological risk to the person affected and without causing any damage to the object.

In one embodiment such as that defined in claim 11, when the closure mechanism applies pressure to body parts of the machine user, a relatively large contact surface is obtained, thereby resulting in a lower surface pressure acting on the relevant part of the body, such as the hand or wrist, for example, so that the risk of injuries to the machine user is likewise reduced.

The risk of injury to a user is also minimized by the embodiment defined in claim 12, since there are no sharp edges or sharp corners on areas of the machine which potentially pose a risk.

Also of advantage is an embodiment defined in claim 13, because when running up against an obstacle, a sufficient contact surface is obtained, thereby assuring a relatively low surface pressure.

Also of advantage is an embodiment defined in claim 14, because there are no cutting edges on which the risk of injury due to cutting might be high.

As defined in claim 15, when the closure mechanisms are moving, in particular when the slide is moving, body parts, items of clothing or objects are reliably prevented from being pulled into the spaces or gaps.

Extra protection is provided against trapping at the front or side boundary edges of the closure mechanism by the features defined in claim 16 and/or 17. Such brush or rubber deflectors represent an inexpensive protection against injury and these features can also help to improve visual appearance and enhance the value or quality of the machine.

The advantage of the embodiment defined in claim 18 is that a user is prepared for the automatically initiated movements of machine or the fact that they are about to be initiated and is thus effectively made aware of any risks.

A preferred design of the machine is defined in claim 19. The advantage of this is that an embodiment of this type has a plurality of functionally reliable automation options and also a plurality of compartments can be managed or controlled without needing a large number of slide elements. In particular, only one slide element which can be displaced in a controlled manner is provided for a plurality of compartments within a compartment plane, which means that the mechanical and structural complexity of the machine is relatively low even though a high degree of automation can be achieved.

Also of advantage is an embodiment defined in claim 20, because it also prevents the slide elements from trapping objects or limbs when the slide elements are moving. One advantage of providing a protective door is that the slide elements lying behind can be moved by means of what are preferably frictionally retained drives but the protective doors disposed in front of them mean that they pose no risk.

The advantageous embodiment defined in claim 21 increases the degree of automation and permits procedures which require no actions or virtually automatic procedures, thereby making the machine easy to use. Due to the properties of the protective door drive, there is nevertheless basically no risk of injury to any users or untrained users.

As a result of the features defined in claim 22, a high level of security against unauthorized access to machine compartments is achieved. Moreover, due to the automatic disabling of this tumbler or lock integrated in the control sequence, no inadmissible or dangerous states can occur because the machine control system only ever disables the tumbler or lock if risk-free access is possible or if a risk-free state prevails. In particular, the lock or tumbler for the respective protective door or the respective protective doors is only disabled if the compartment system, for example in the form of a carousel-type compartmentalized magazine, has come to a standstill or is stationary.

The personal safety of the machine can be further enhanced as a result of the features defined in claim 23, whereby the control mechanism can prevent or avoid an opening movement of the slide elements lying behind the protective door when an open protective door is automatically detected.

The advantage of the embodiment defined in claim 24 is that a plurality of objects can be deposited relatively quickly, for example by a delivery service. Since the time needed for the depositing process can be reduced, the associated costs can also be reduced, in addition to which the convenience of the machine if making bulk deposits of objects is significantly increased.

Also of advantage is the embodiment defined in claim 25, because it results in a high degree of security against unauthorized access to the compartments and increases security against break-ins.

Due to the features defined in claim 26, unauthorized or forced opening of the slide element is barely possible or is so only by applying extreme fore. Furthermore, the mechanical locking of the slide elements offers additional personal safety because access to a magazine system, preferably in the form of a carousel-type round magazine, which might be moving behind the closure mechanism under certain circumstances is reliably prevented.

Also of particular advantage is the embodiment defined in claim 27, because any undetected faults in the control software or unforeseen states can not lead to a loss of security because a slide element is not opened until there is a high degree of certainty that a moving and in particular a rotating compartment system is stationary. Another advantage is that this obviates the need for a special expensive security software with complex security checks which would make maintenance and part replacements problematic.

The embodiment defined in claim 28 and/or 29 is of advantage because it results in an active status check as to whether the slide tumbler is working or functioning so that potentially risky movements, in particular movements of the compartment system lying behind, are not initiated until the slide elements are reliably locked. This increases the safety of the machine for what are usually untrained users or operators.

The user and personal safety of the machine is also advantageously increased due to the embodiment defined in claim 30 because a closing or opening operation of the closure mechanism only takes place deliberately or is only effected if accompanied by active initiation by the user. As a result of these features, the user is easily alerted beforehand that a movement, in particular a pushing movement, must be effected on the machine so the user can not be taken aback or surprised because he is already prepared. A further increase in safety may optionally be achieved by providing a safety button which must be operated by the user during the entire closing operation of the closure mechanism and if the button is released before the operation of locking the closure mechanism has terminated, the closing operation is immediately interrupted and the closure mechanism is opened again.

Of particular advantage in this respect are the features defined in claim 31 and/or 32, because the closing or opening operation can not be initiated except by persons who have a sufficient understanding of the possible risks or are able to see the potential for such risks. Another particular advantage of this feature is that the possibility of children being unintentionally locked in, e.g. due to game playing or an inappropriate show of bravado, can be virtually ruled out and in particular, children can not lock other children or animals or objects in an open machine unobserved.

Also of advantage is the embodiment defined in claim 33, because in order for the machine to be able to make a movement which might potentially pose risks it is a requirement that a user must deliberately activate the safety switch system, thereby obtaining authorization for a movement, in particular a sliding or opening movement of the closure mechanism. The increased personal safety of the machine is thus assured by the safety switch system and not by the machine control system and its software, which significantly reduces the costs incurred for control plus software, especially as regards any software modifications which might be needed and the effort involved in certification.

The advantage of the embodiment defined in claim 34 is that when the timer is started, an automatic closing movement of the closure mechanism is possible for a limited time. When this predefined release period has elapsed, it is no longer possible to close the closure mechanism, in particular the slide elements, so that an exactly defined, limited time is allowed, within which a closing movement can be automatically effected. The release time is advantageously slightly more than the usual time taken by the closure mechanism to close. This ensures that the closure mechanism is closed only if deliberately released by a user and whilst he is watching it.

As a result of the embodiment defined in claim 35, if the closure mechanism, in particular the slide elements, have not yet reached their end position when the switching time elapses and can therefore also not be locked, the slide elements, which are provided with drives that are not frictionally retained, can be freely pushed. To make another attempt at closure, it is preferable if it is necessary to activate the safety switch mechanism again. This also minimizes risks to persons because if a machine is left with the closure mechanism not fully closed, it can not be pushed into the closed and locked position by a child.

The advantageous features defined in claim 36 and/or 37 ensure that the closing operation must be deliberately initiated by a user so that any unintentional or automatic locking in of living beings is ruled out and critical or dangerous objects can only be deposited intentionally. By means of the log data which may be recorded in the storage machine, it is then possible to ascertain who the responsible person is, for which purpose it is preferable to run a user identification check before the storage machine is used.

The features defined in claim 38 result in a highly safe and particularly failsafe control of the drives of the storage machine which potentially pose risks. Another advantage is that these features obviate the need for complex and expensive security software with corresponding security certificates, because reliability in the event of faults is significantly improved by the inter-linking of the specified control units.

Also of advantage is an embodiment defined in claim 39, because if an obstacle gets within the displacement path of the closure mechanism, the latter is not continually pushed against the obstacle and instead a failed automatic closure attempt is automatically interrupted if the closed position is not reached within the predefined time.

The advantage of the embodiment defined in claim 40 is that a slide element can be actively locked within a defined time only, which means that the possibility of a child being locked in, for example due to dangerous play on an unsupervised machine or due to an act of bravado, can be ruled out since the closure mechanism can be actively locked within a limited time only. This time is preferably selected so that an authorized user of the machine is pre-sent and at least still in the vicinity if the release time for an automatic locking option of the closure mechanism is still running. In other words, it is preferable if the slide elements can also not be manually closed outside the release time, in particular can not be locked.

The features defined in claim 41 also offer a simple and reliable way of preventing persons or objects from being inadvertently locked in.

As a result of the features defined in claim 42, even if an identification means is left behind in the machine, such as a PIN-free magnetic card left at the machine, there is no danger of a person being undesirably or negligently locked in the machine and also no risk of objects being deposited by unauthorized persons.

The features defined in claim 43 also advantageously contribute to increasing the personal safety of the machine. In particular, a feature is proposed to prevent a child from being accidentally locked inside the machine. By determining weight in this manner, it is also possible to detect automatically whether the compartment system is overloaded, and this feature can therefore be used to protect mechanical components of the machine and to protect the functions of the drive and brake systems. Another advantage resides in the fact that, because it is possible to run an automated check to ascertain that the maximum permissible load regulations are being complied with or that the technical load limits of the machine are being complied with, risks to a user can be ruled out if components of the machine become broken or damaged.

As a result of the embodiment defined in claim 44 and/or 45, it is possible to ascertain whether, following an operation initiated at the machine to remove something, the total weight of the compartment system or the monitored compartment has reduced or has at least stayed the same, thereby preventing unauthorized deposits of objects and enabling children to be detected prevent them from being locked in on an automated basis.

The feature defined in claim 46 also enables an automatic check to be run in order to ascertain whether, after a user has initiated a removal operation, the object was actually removed or whether, after the specific object was removed another object was deposited in the storage machine inadmissibly or without authorization. It may also be possible to tell if a child or an animal has climbed in and then prevent or interrupt an automated closing operation of the closure mechanism.

As a result of the advantageous embodiment defined in claim 47, the operating convenience of the machine can be further enhanced and a certain amount of time can also be saved between directly consecutive depositing and retrieval operations.

The features defined in claim 48 are of advantage because damage to the machine and associated down times and risks for a user of the machine can be virtually eliminated.

Finally, an embodiment as defined in claim 49 is of advantage. The weight detection system in this instance is used to detect attempts to break in or thieve, which also increases security against unauthorized access.

BRIEF DESCRIPTION OF THE DRAWINGS

The invention will be described in more detail below with reference to examples of embodiments illustrated in the appended drawings.

Of These.

DETAILED DESCRIPTION OF THE PREFERRED EMBODIMENTS

Figure 1:
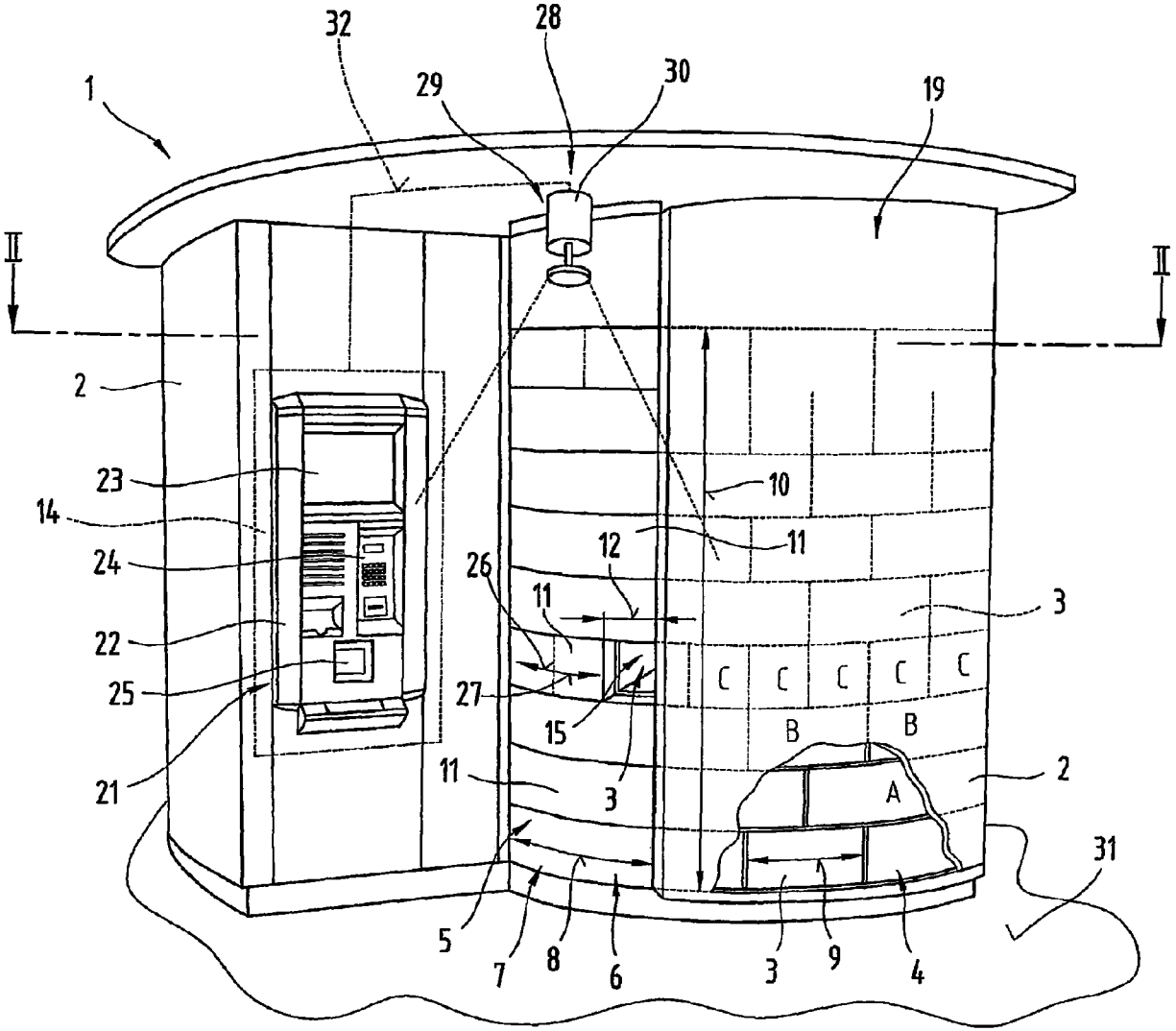
FIG. 1 is a highly simplified, schematic diagram illustrating a preferred embodiment of a storage machine with safety features for increasing personal safety.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
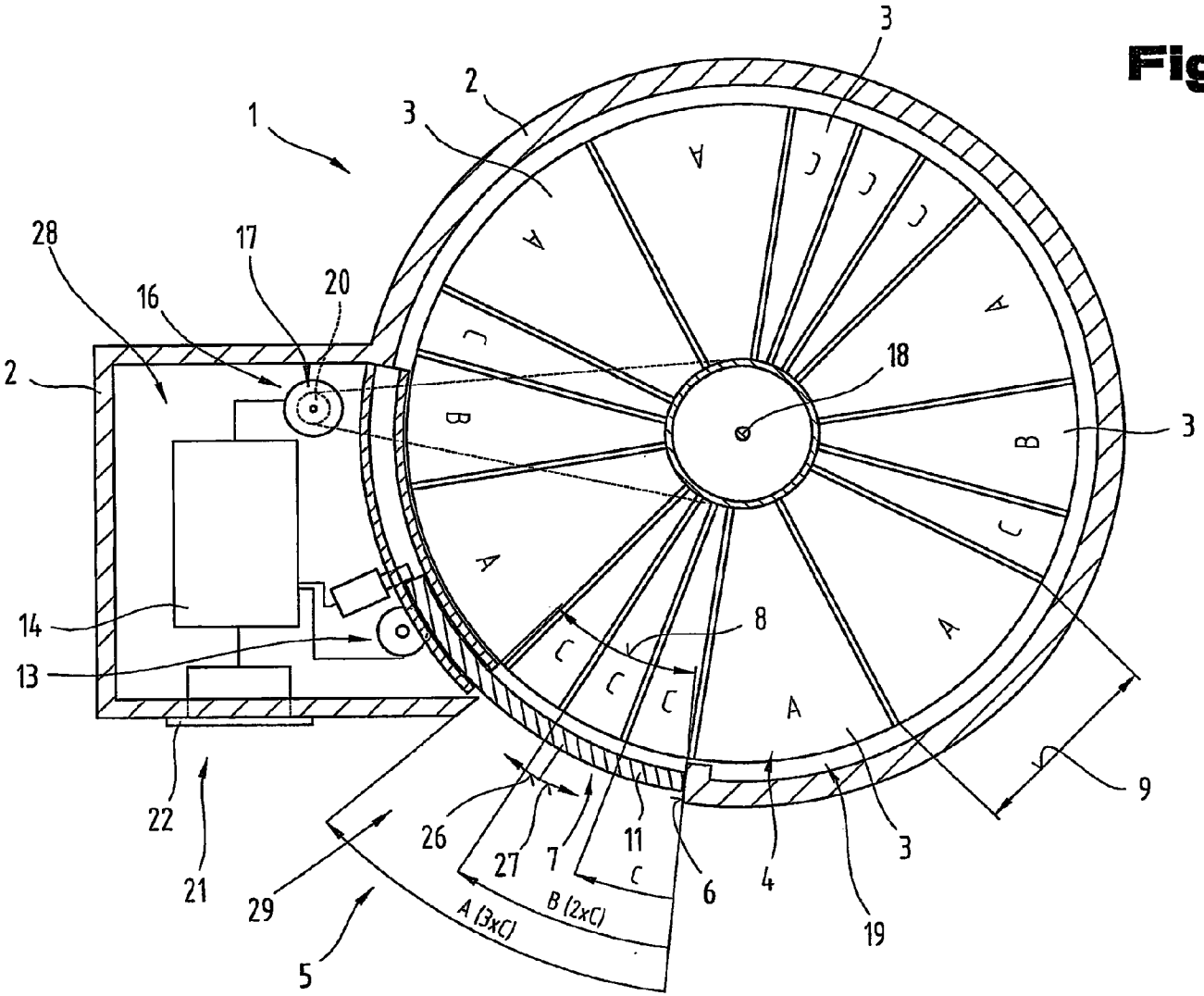
FIG. 2 is a schematic diagram showing an example of the storage machine illustrated in FIG. 1 in section along line II-II indicated in FIG. 1.

FIGS. 1 and 2 provide a schematic illustration of one possible embodiment of a storage machine proposed by the invention. An electromechanical storage machine 1 for various objects or goods is preferably used as a parcel deposit or parcel dispensing machine for the postal service or delivery services. Such a storage machine 1 may optionally also be designed for use as a vending machine for goods or for use at a left-luggage office in railway stations or airports. However, a storage machine 1 of this type may also be adapted so that it can be used for the renting or hire of different types of objects, such as tools, for example, or as a drop-off and collection station for various services, such as dry cleaning, photographic processing, repairs and similar. It may likewise be used as a locker system for clothing, for example at swimming pools or fitness centers, for example.

In particular, such a storage machine 1 may be used for temporarily storing objects or for transferring objects between different persons present at the hand-over point, i.e. the storage machine 1, at different points in time, However, such a storage machine may also be used for dispensing or selling objects without the need for sales personnel to be present.

The storage machine 1 has a machine housing 2, which is strong enough to prevent unauthorized access and vandalism and which essentially defines the external contour of the machine. The machine housing 2, which is access-proof and burglar-proof in particular, is therefore designed as a mechanical access protection for the objects stored inside the machine. This being the case, parts of the machine housing 2 may also be provided with some other system surrounding them, such as a wall structure or similar, for example, thereby protecting the respective objects against unauthorized access.

The machine housing 2 surrounds at least some portions of a plurality of compartments 3, which are provided as a means of temporarily depositing a plurality of objects or goods. The compartments 3 may be laid out in a field or matrix pattern or alternatively may be of a carousel or magazine type structure. This means that inside the machine housing 2, a matrix-pattern or field pattern or a round magazine-type compartment system 4 can be set up, with a plurality of individual compartments 3 open at one side. The compartments 3 of the compartment system 4 are preferably designed in at least two different sizes, to permit the storage of parcels or objects of different sizes. In the embodiment illustrated as an example, three compartment sizes are provided. In particular, large compartments A, medium-sized compartments B and small compartments C are provided.

The individual compartments 3, preferably of different sizes, in particular with different width dimensions, may optionally contain special devices for storing specific objects, such as retaining mechanisms, cups, compartment dividers or similar. The compartments 3 may also contain devices for creating specific storage conditions, such as heating devices, cooling devices, air humidifiers, lighting units, moving mechanisms, devices for creating a protected atmosphere or for germ-free storage and similar, for example, and are connected to such devices.

To enable access to individual or specific compartments 3 of the compartment system 4 to be controlled on an automated basis, the storage machine 1 also has at least one access mechanism 5. In particular, the machine housing 2 is provided with at least one access orifice 6 to compartments 3 of the compartment system 4 which can be selectively released and locked. This access orifice 6 in the machine housing 2 or in some other surround of the machine, the size of which is predefined in terms of its width and height dimensions in particular, is preferably disposed in a central position of the machine housing 2. This access orifice 6 in the machine housing 2 can be released at least partially or in some regions or alternatively completely closed or locked to prevent access by means of at least one closure mechanism 7 which can be displaced relative to the access orifice 6 or relative to the machine housing 2. Due to a co-operation between the access orifice 6 in the machine housing 2, which is of predefined dimensions, and the closure mechanism 7, access options can be selectively granted or prevented for a specific individual compartment 3 or a specific compartment group. A largest width 8 of the access orifice 6 essentially corresponds to a compartment width 9 of the biggest compartment 3A of the compartment system 4. A height 10 of the biggest possible access orifice 6 in the machine housing 2 essentially corresponds to the total height of the compartment system 4 lying behind. A largest width 8 of the access orifice 6 essentially corresponds to a compartment width 9 of the biggest compartment 3A of the compartment system 4. A height 10 of the biggest possible access orifice 6 in the machine housing 2 essentially corresponds to the total height of the compartment system 4 lying behind. In other words, the vertical dimension of the access orifice 6 or the access opening of fixed maximum size in the machine housing 2 essentially corresponds to the biggest height of the compartment system 4. In the preferred embodiment based on a carousel or round magazine-type compartment system 4, the access orifice 6 extends across all the compartment levels disposed one above the other.

As a result, a free cross-section or orifice size of the access orifice 6 provided in the machine housing 2 is preferably bigger than the cross-sectional surface of the biggest compartment 3A lying behind at its open front face directed towards the closure mechanism 7. In particular, the central access orifice 6 in the machine housing 2 extends, in terms of its height, at least across one compartment level of the preferably several compartment levels of the compartment system 4 and in the direction of the width at least across the compartment width 9 of the widest compartment 3A within the respective compartment level. In the vertical direction, a single access orifice 6 preferably extends across the height of all the compartment levels of the several compartment levels incorporated in the compartment system 4. Alternatively, it would also be possible to provide separate access orifices 6 in the machine housing 2 for the compartment levels, the widths 8 of which are adapted to the width of the widest compartment 3A in the respective compartment level.

It would also be conceivable to provide a central access orifice 6 which is merely subdivided by slim webs, disposed congruently with the compartment bases or compartment dividing planes of the compartment system 4.

The access mechanism 5 or closure mechanism 7, which can be controlled on an automated basis, has at least one slide element 11 or has one or several doors, which permit or prevent access to compartments 3 lying behind inside the surround of the access orifice 6.

Every available compartment level is provided respectively with a closure mechanism 7 in the form of at least one, preferably a single, slide element 11 displaceable in the horizontal direction or guided in the horizontal direction, which, depending on the requisite opening width 12, essentially corresponding to the compartment width 9 of a compartment 3A, 3B, or 3C lying behind, and controls access to the specific compartment 3 for the respective user or for the specific compartment group intended for the respective user.

Adjacent to a compartment 3 of a specific height, several compartments 3 of a shorter height may also optionally be provided in a specific vertical pattern. The vertical dimensions of the closure mechanisms 7 and their positions correspond to the vertical pattern.

To enable the closure mechanism 7 or at least a slide element 11 to be displaced automatically, at least one drive system 13 is provided. A reversible drive system 13 is preferably provided for every slide element 11 of the closure mechanism 7. Alternatively, it would also be possible to provide a drive system 13 by means of coupling mechanisms co-operating with several slide elements 11 which can be selectively activated and deactivated. This at least one drive system 13 for the closure mechanism 7 is designed to control the positioning of the closure mechanism 7 or the respective slide 11 as a function of the respective size, in particular the compartment width 9, of a compartment 3A, 3B or 3C to be accessed by an authorized user. In particular, the opening width 12 of the closure mechanism 7 or the individual slide elements 11 may be varied so that the opening width 12 corresponds either to the width of compartment A, or the width of compartment B or the width of compartment C, as a result of which the user is afforded access only to the respective compartment 3 intended for the user or to an authorized compartment group, and all the other compartments 3 behind the closure mechanism 7 or the slides 11 and the machine housing 2 remain protected against access. By compartment group in this context is meant a specific group of adjacent compartments 3.

The height of the individually displaceable slide elements 11 disposed one above the other is adapted more or less to the height of the compartment level lying behind or the height of the compartments 3 within this level of the compartment system 4. Within a compartment level, therefore, a plurality of compartments of differing compartment widths 9 is provided, as may best be seen from FIG. 2.

The individual slide elements 11 or alternatively several doors of the closure mechanism 7 can preferably be driven or displaced by means of at least one respectively co-operating drive system 13, which can be activated by an electronic control system 14 of the machine. The sum of the compartments 3 in the preferred embodiment of the storage machine 1 is greater than the sum of the individual slide elements 11 or doors in front of the differently sized compartments 3. The closure mechanism 7 may therefore provide a defined individual access orifice 15 with a size which is variable in at least one but also in two dimensions, as may clearly be seen from a comparison of FIGS. 1 and 2.

The example of an embodiment described above, with slide elements 11 disposed vertically one above the other, therefore permits controlled individual access at every compartment level to a rearwardly lying compartment portion of the compartment system 4 of the machine inside the machine housing 2, via an access orifice 6 with a relatively large surface area. In particular, an object can be deposited or an object removed through the respective released access portion and via an individual access orifice 15 defined by the closure mechanism 7 in terms of its size and its position relative to the machine housing 2 and relative to the maximum possible access orifice 6. All the other slide elements 11, which remain closed as before, safely continue to protect against unauthorized access to adjacent compartments 3 and to their compartment contents.

The preferred embodiment of the machine also has a transport mechanism 16, by means of which a controllable relative displacement of the compartments 3 or of the entire compartment system 4 or individual compartment levels can be effected relative to the housing-side predefined maximum access orifice 6 in the machine housing 2. The transport mechanism 16 has at least one drive unit 17 for the displaceably mounted compartment system 4. By preference, the compartment system 4 is provided in the form of a round magazine 19 rotatable about a vertical axis 18, with which a rotary drive 20 co-operates. This rotary drive 20 may be a rotary drive of any type known from the prior art, in particular a gear mechanism, a belt drive, a chain drive or a cable drive. The round magazine 19 is preferably mounted so that its height remains constant, i.e. its compartment levels always remained in the respectively predefined plane and are thus rotatable about the vertically extending axis 18.

To enable the respective functions of the storage machine 1 to be run on an at least partially automated basis, the storage machine 1 is provided with at least one electric or electronic control system 14 or has one integrated in it. In a manner known per se, such an electric control system 14 comprises at least one software-driven processor or micro-controller for controlling, monitoring or regulating at least the internal processes and/or the device functions. To this end, the control system 14 has several electrical or optical interfaces for co-operating actuators and/or sensors of the storage machine 1. The control system 14 also comprises, amongst other things, a standard computer unit for general applications, in particular a standard PC or industrial PC.

The control system 14 also serves as a user interface, in particular what is referred to as a man-machine interface, such as a user interface 21. This user interface 21 is provided in the form of a terminal 22 integrated in the storage machine 1 but may naturally also be provided separately, disposed at some distance from the actual storage machine 1 incorporating the various compartments 3. The user interface 21 or the terminal 22 has input and/or output means 23 of a type known from the prior art for influencing the operating functions or processes of at least the storage machine 1. These input and/or output means 23 may be provided in the form of buttons, switches, displays and/or by combined input and/or output means 23, such as a touch-sensitive screen otherwise known as a touchscreen, for example. The storage machine 1 preferably also has a document scanner, barcode scanner and receipt printer.

The input and/or output means 24 may also be any identification and/or authorization checking means 24 known from the prior art. An electronic unit of this type for checking persons and authorizations may be provided in the form of a card reader for identity cards or for credit or debit cards (EC cards) and/or in the form of input means for the user's name and optionally for passwords or PIN codes. The user identification may also be based on barcode portions, biometric identification systems, such as fingerprint sensors, speech recognition modules and/or mechanical keys or transponders or a combination of several of such means, for example.

The input and/or output means 23 for data or information and commands may also be provided in the form of optoelectronic scanners 25, magnetic card or chip card readers, electromagnetic transmitter and/or receiver devices and similar and may be integrated in the storage machine 1 and connected to the control system 14.

The amount of electrical or electromechanical equipment provided in the storage machine 1 will essentially depend on the required functions, and it would be conceivable to provide a series of extension stages or special functions for the storage machine 1, as will be explained in more detail below. The electromechanical input and/or output means 23 of the machine also specifically permit a data communication with decentralized sites, in particular with a management center for several storage machines 1 installed at different sites. The input and/or output means 23 also permit communication with the respective users or operators of the storage machine 1.

The transport mechanism 16 enables at least one selected compartment 3 contained in the compartment system 4, which is preferably displaceable as a whole, to be positioned in the access region behind the access mechanism 5. To this end, it is preferable to use the schematically illustrated construction with round or drum-type rotatable magazines or alternatively with paternoster-type compartment systems which are linearly displaceable or circulate on a belt-type system. However, it would also be possible to use machines with stationary compartment systems 4 or magazines which have automatically driven closure mechanisms 7 and correspond to the concept proposed by the invention.

A major advantage of the generic storage machine 1 is the relatively flexible option for splitting the total compartment volume into compartments 3 of different sizes, the layout of which can be adapted to the intended usage conditions, i.e. accommodating storage objects of different sizes. It is preferably also possible to set up the sub-division of the magazine volume after the storage machine 1 has been placed in operation. Such modification or adjustment of the compartment sizes would be possible but difficult if using box-type storage machines or locker compartments where the size of a door has to be adapted to each individual compartment.

The closure mechanisms 7 or the individual slide elements 11 are preferably moved on an automated basis by the control system 14. In particular, the closure mechanism 7 can be moved in the opening direction—arrow 26—by means of the drive system 13. The respective opening width 12 of the closure mechanism 7 is therefore dependent on the size of the compartment 3 positioned behind or depends on the access rights of the respective user determined beforehand by the electronic input and/or output means 23.

The operation of closing the closure mechanism 7 is preferably effected from the control system 14 via the drive system 13, likewise on an automated basis. In other words, an individual access orifice 15 previously made available to afford access to a compartment, with a specific opening width in the respective compartment level, is completely closed again or moved into the closed position once a defined period has elapsed or following a manual closure command entered by the user once an object has been deposited or once an object has been retrieved, for which purpose the closure mechanism 7 or the at least one slide element 11 is moved in the direction of arrow 27. To this end, it is preferable to use the same drive system 13 as that provided for the opening movement of the closure mechanism 7.

This automatically moved closure mechanism 7 poses a certain potential risk to a user of the storage machine 1, because moved parts can cause risks to the health of persons in certain situations if driving forces that are critical to injury have to be used on the machine or if the machine is not correctly operated or is not used for its intended purpose. A storage machine 1 for objects proposed by the invention is distinctive due to the fact that it has at least one safety system 28 offering extensive, increased personal safety to protect against risks caused by automated processes and due to its automatically displaced drives, as will be explained below. By moved drive is meant the at least one drive system 13 for the at least one closure mechanism 7 and/or the at least one drive unit 17 for the compartment system 4.

As schematically illustrated in FIG. 1, the storage machine 1 may be provided with at least one monitoring system 29 to increase personal safety, which monitors an area in front of the compartment opening of at least one compartment 3. A monitoring system 29 of this type is preferably provided as a means of monitoring an access or reaching-in area of the compartment opening of at least one compartment 3. Such a monitoring system 29 is preferably provided for the storage machine 1 on the basis of electromechanical means. In the embodiment illustrated in FIG. 1, the predominantly automatically functioning monitoring system 29 has at least one camera arrangement 30. This being the case, a detection direction or a detection plane of this camera arrangement 30 preferably extends more or less perpendicular to or at a slight angle to a standing plane 31 of the storage machine 1. The at least one camera arrangement 30 is preferably mounted in the upper portion of the storage machine 1 and thus detects the portions of the storage machine 1 lying below and the area in front of the central access orifice 6 with the automatically releasable and closeable compartment openings of the compartment system 4.

The camera arrangement 30 may be mounted on a projection of a roof of the storage machine 1 and will thus have an image detection plane oriented parallel with or at a slight angle to the standing plane 31 of the storage machine 1. This ensures that with only one camera arrangement 30 or only a few camera modules, the access area in front of the compartment system 4 or the reaching in area of the central access orifice 6 can be reliably detected with as few gaps as possible.

The monitoring system 29, in particular the camera arrangement 30, is actively connected to a co-operating control unit or to the central control system 14 of the storage machine 1 or to a control system for the at least one closure mechanism 7. In particular, the monitoring system 29 is coupled with at least one of the drive systems 13 and/or the drive unit 17 for the relatively displaceable compartment system 4 for control purposes. In the situation where the monitoring system 29 detects an object, in particular a hand, a foot or any other part of a person's body in the critical danger area to be monitored, the drive system 13 of the closure mechanism 7 or drive unit 17 for the compartment system 4 which might pose a risk under certain circumstances is stopped and switched to a state that is safe as regards persons or objects. The danger area to be monitored primarily includes the displacement area or displacement path of the closure mechanism 7 or the slide elements 11 and/or the area immediately in front of the automatically moved compartment system 4. Especially if at least one of the drive systems 13 for the at least one closure mechanism 7 is activated and/or above all if the drive unit 17 for the compartment system 4 is active, the monitoring system 29 is also ready for operation or active so that if a state which is dangerous to a person suddenly occurs or if an object moves into the monitored danger zone, it is in a position to switch off the respective drive or move the respective machine components into a safe state immediately on an automatic basis. In the danger situation, therefore, the monitoring system 29 causes a signal to be transmitted accordingly to the control system 14 or the monitoring system 29 prompts the potentially dangerous drives 13; 17 to be switched off or switched back directly.

In the embodiment of the monitoring system 29 based on a camera arrangement 30, it has at least one CCD module for recording image data in a known manner. The camera arrangement 30 is connected via at least one line 32 to the evaluation system for the detected image data or to the control system 14 which may optionally assume this function. The evaluation system or control system 14 is run on the basis of software and enables objects entering the danger area to be sensed or detected so that in the event of such an evaluation result, an adequate danger signal causes the drive power to be shut down or a safe operating mode to be assumed. However, the software-driven evaluation system may also be disposed inside the camera arrangement 30 and already forward an appropriate evaluation or danger signal to the control system 14 or directly to a switch mechanism for the drive system 13 and/or the drive unit 17.

Figure 3:
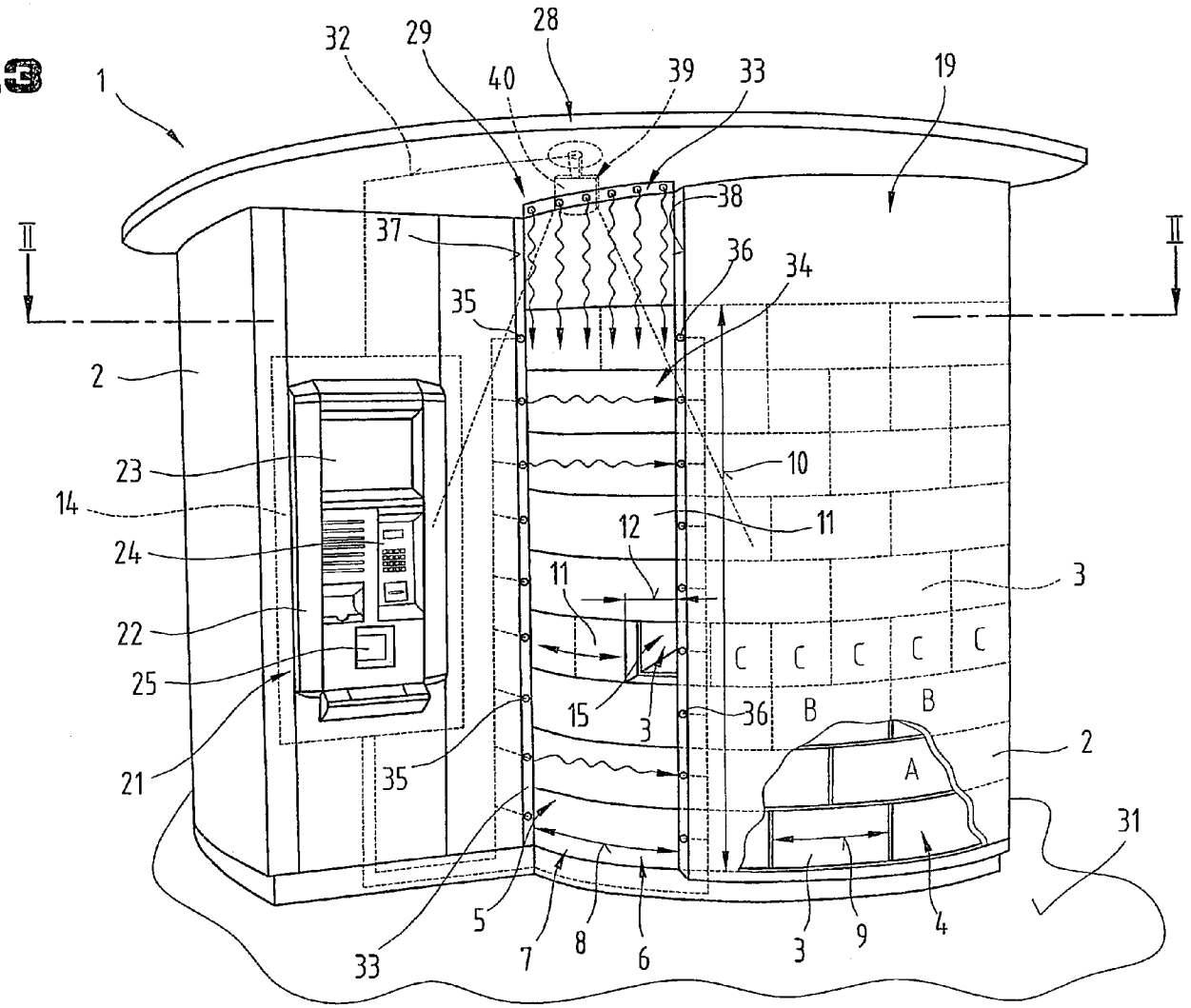
FIG. 3 is a schematic diagram showing an example of another embodiment of a safety system for a storage machine.

Alternatively or in combination with the type of embodiment of the monitoring system 29 illustrated in FIGS. 1 and 2 based on evaluating image data, the optoelectronic monitoring system 29 illustrated in FIG. 3 represents another possible option.

In the embodiment illustrated in FIG. 3, the safety system 28 or monitoring system 29 has at least one photoelectric barrier system 33 or a light curtain or light screen 34 in front of a compartment opening or in front of the central access orifice 6, by reference to an access direction to the compartment system 4. The photoelectric barrier system 33 can therefore emit a light screen 34 or a light curtain or also merely a single light beam. The respective light beams therefore extend in a plane oriented at least approximately vertically with respect to the standing plane 31. The photoelectric barrier system 33 may operate on the basis of the reflection principle, i.e. may be formed by a so-called reflection light barrier, whereby the transmitter and receiver elements for the wave radiation lie at one point or next to one another. If, as is the case with reflection optical barriers of this type, the emitted light is reflected or received again in some other way or no longer reflected, this change of state will be taken as meaning that an object has penetrated the danger zone under surveillance and a danger signal can be emitted or output accordingly.

Light is preferably emitted by the photoelectric barrier system 33 which is in a wavelength range that is invisible to humans. The photoelectric barrier system 33 is therefore designed for emitting and/or receiving infrared light.

FIG. 3 schematically illustrates a photoelectric barrier system 33 which operates on the reflection principle in the top region of the machine housing 2. Alternatively or in combination with this, the photoelectric barrier system 33 may also run on the transmission and reception principle, in which case it will comprise at least one light transmitting element 35 and at least one light receiving element 36 spaced at a distance apart from it for light emitted by at least one light transmitting element 35. This at least one light transmitting element 35 and the at least one light receiving element 36 are disposed so that the single-line or lattice-type photoelectric barrier system 33 is created in the area in front of the access orifice 6. The at least one light transmitting element 35 and light receiving element 36 is preferably designed to emit and detect infrared light. The light transmitting and light receiving elements 35, 36 are preferably disposed on non-moving components or rigid portions of the machine housing 2. In the embodiment illustrated as an example, the light transmitting and light receiving elements 35, 36 are disposed on lateral, oppositely lying boundary surfaces 37, 38 of the access orifice 6. This results in a harmonious and vandal-proof integration in the machine housing 2 on the one hand and also creates a functionally reliable and structurally simple monitoring system 29 for the danger zone in front of the automated closure mechanisms 7 or in front of the automatically moved compartment system 4.

As also schematically illustrated in FIG. 3, in an alternative embodiment, the monitoring system 29 may also be provided in the form of a transmitter and/or receiver system 39 for infrared light and/or for ultrasound, as schematically indicated by broken lines. In particular, this transmitter and/or receiver system 39 may be provided in the form of a so-called passive infrared detector, which transmits or sends a sensor signal if an infrared radiation source moves into the monitored region or danger area of the storage machine 1, signaling the entry of a person or living being in the monitoring zone. The at least one passive infrared detector 40 is preferably mounted on the machine housing 2 and has a detection range or detection zone which largely extends beyond the entire central access orifice 6. The sensing or detection range of this passive infrared detector 40 is of a relatively narrow design by reference to a direction parallel with the access direction to the compartment system 4. By reference to this access direction to the storage machine 1, the so-called depth of the detection zone of the monitoring system 29 is approximately 0.7 m at most. This ensures that the monitoring system 29 keeps only a potentially risky portion in front of the access orifice 6 of the storage machine 1 under surveillance and persons or objects at a sufficiently safe distance in front of the access orifice 6 can not disrupt the at least partially automated sequence of the storage machine 1. This results in increased personal safety on the one hand and also ensures undisturbed machine operation. Using a passive infrared detector 40 for the monitoring system 29 thus offers the possibility of setting up an inexpensive and at the same time reliable monitoring system 29 for protecting the automated motion sequences with respect to persons and living beings. Instead of using an infrared detector 40, it would also be possible to use ultrasound signals as a means of checking or controlling the presence of an object or person within the danger zone or within the monitoring range directly in front of the access orifice 6, which is exactly delimited in spatial terms.

Figure 4:
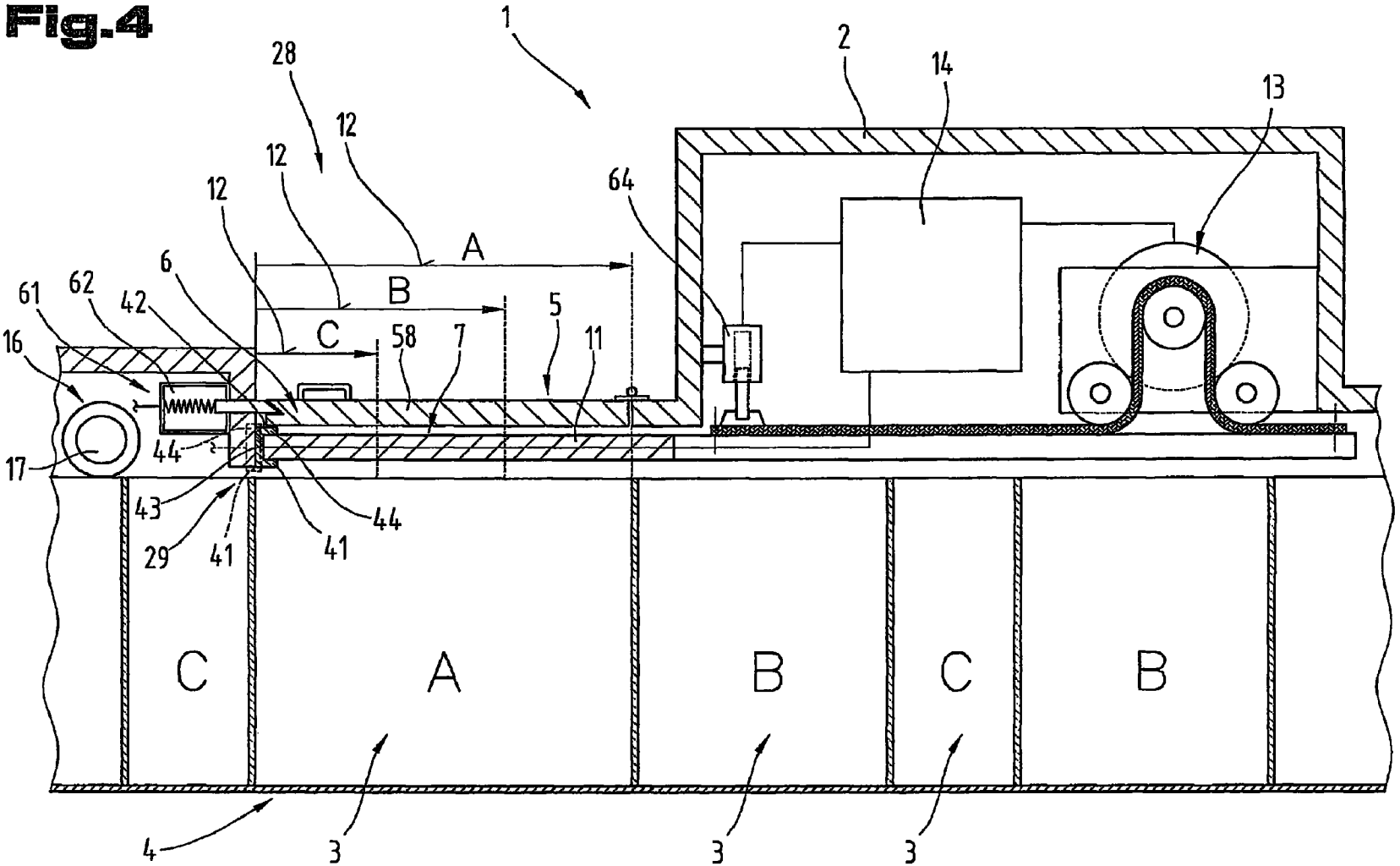
FIG. 4 is a simplified diagram in section illustrating another storage machine with increased personal safety.

As schematically illustrated in FIG. 4, the safety system 28 or monitoring system 29 for increasing personal safety may also be provided in the form of at least one stop or contact bar 41. Such a stop or contact bar 41 for automatically cutting off a movement, in particular a closing movement of the closure mechanism 7, is disposed in at least a front end portion by reference to the closing direction or in a portion of the closure mechanism 7 or a slide element 11 lying adjacent to the front closing edge, as indicated by solid lines in FIG. 4. Alternatively or in combination with this—as symbolically indicated by broken lines—at least one stop or contact bar 41 may be provided on a housing-side abutment edge 42 for the closure mechanism 7 or the respective slide elements 11 bounding the compartment opening on the machine housing 2. As schematically indicated, this at least one stop or contact bar 41 is connected to the control system 14 or directly to the drive system 13 so that when an object, such as a hand for example, is detected in the danger area or displacement path of the closure mechanism 7, the potentially dangerous movement can be at least directly cut short. The monitoring system 29 and the at least one stop or contact bar 41 can therefore prevent or cut short any further closing operation if an obstacle is detected in the monitoring or danger area, i.e. in the displacement range of the closure mechanism 7, or emit a signal for the closure mechanism 7 to be opened again. This will prevent any jamming of objects, and injury to persons who might not be paying attention under certain circumstances can be virtually ruled out, even though strong and hence relatively force-resistant drives and force transmitting elements may be used between the drive system 13 and the closure mechanism 7 or slide element 11. In other words, it is also possible to use rigidly couple motion transmitting elements and drives with high driving torques but still virtually rule out injury or physical or psychological risks to persons because the automatic monitoring system 29 reliably prevents such risks.

Another option is to provide an elastically flexible and rebounding buffer element 44 against the abutment edge 43 on the closure mechanism 7 and/or on the abutment edge 42 for the closure mechanism 7 on the machine housing 2. Such a soft elastic buffer element 44 on the abutment edge 42 and/or 43 can reduce surface pressure acting on body parts, especially the hand or fingers, thereby providing a simple means of enabling crushing or other injuries to be largely prevented. This being the case, it is also possible to provide the soft elastic buffer element 44 in the form of a stop or contact bar 41 which causes an electric switching function, which reduces surface pressure between moved machine parts and a stationary machine on the one hand and also automatically initiates a safety shut-off or reverse movement of the machine part posing a risk, in particular the closure mechanism 7.

Figure 5:
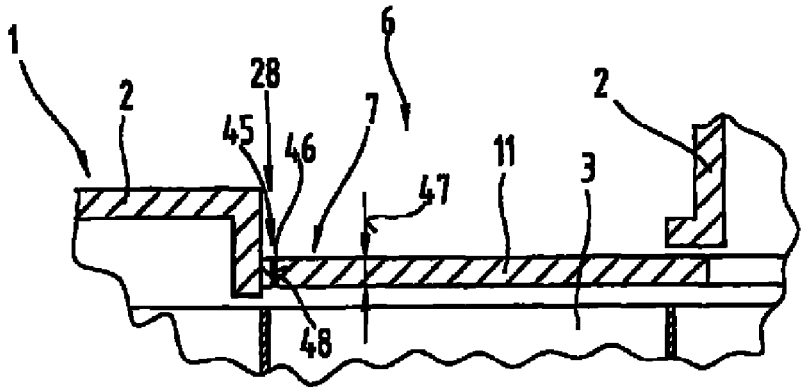
FIG. 5 illustrates other features for increasing personal safety in the access region of a storage machine.

FIG. 5 illustrates other safety systems 28 and features for increasing the personal safety of a generic storage machine 1. In this instance, closing edges 45 on the machine housing 2 and/or on the closure mechanism 7 which can be gripped by the user are provided with radii 46 of more than 2 mm, preferably approximately 4 mm. As a result of such radii 46 on the closing edges 45 of the machine housing 2 and/or at least on the front closing edges of the closure mechanism 7, the risk of injuries such as abrasion or crushing can be significantly reduced.

Alternatively or in combination with this, the closure mechanism 7, in particular the at least one linearly displaceable slide element 11 of the closure mechanism 7, may have a minimum depth or a minimum thickness 47 of approximately 15 mm. This minimum thickness of approximately 15 mm is disposed at least in the front end portion of the closure mechanism 7 or the at least one slide element 11 by reference to the closing direction. The external face of the closure mechanism 7 or the slide elements 11 facing away from the compartment system 4 is preferably completely smooth or at least approximately flat in order to avoid hooking or dangerous crushing edges on the external face of the automatically displaceable closure mechanism 7.

It is also expedient if the closure mechanism 7, in particular the at least one slide element 11 of the closure mechanism 7, hits against boundary surface 48 of the access orifice 6 of the machine housing 2 in a flush arrangement, i.e. as far as possible without any overlap, when the closure mechanism 7 is in the fully closed position. Shearing movements and as a result scraping on body parts or objects due to a closing movement of the closure mechanism 7 can be avoided as a result.

Figure 6:
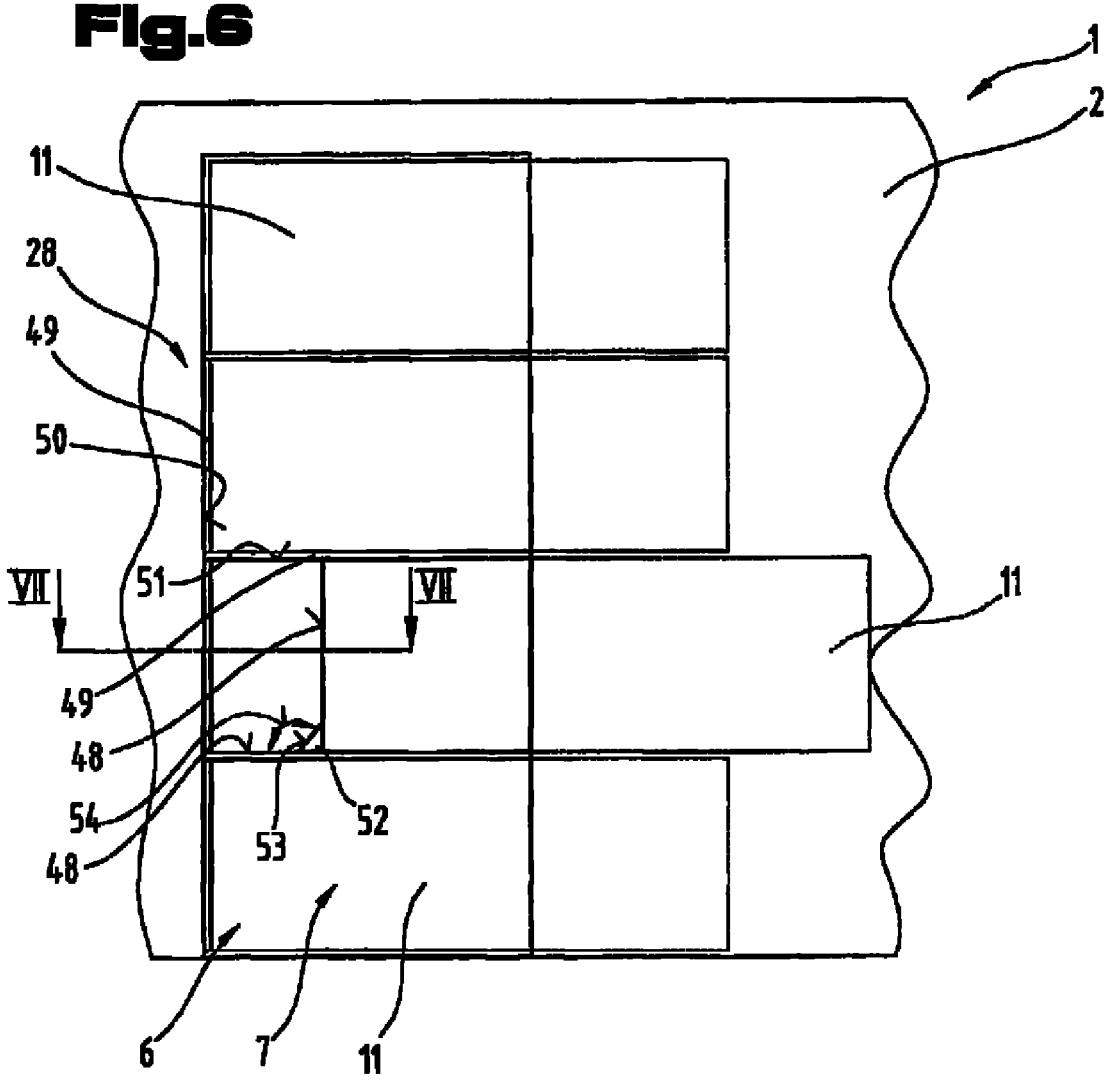
FIG. 6 is a schematic diagram illustrating other safety features for the access region of a storage machine for objects.
Figure 7:
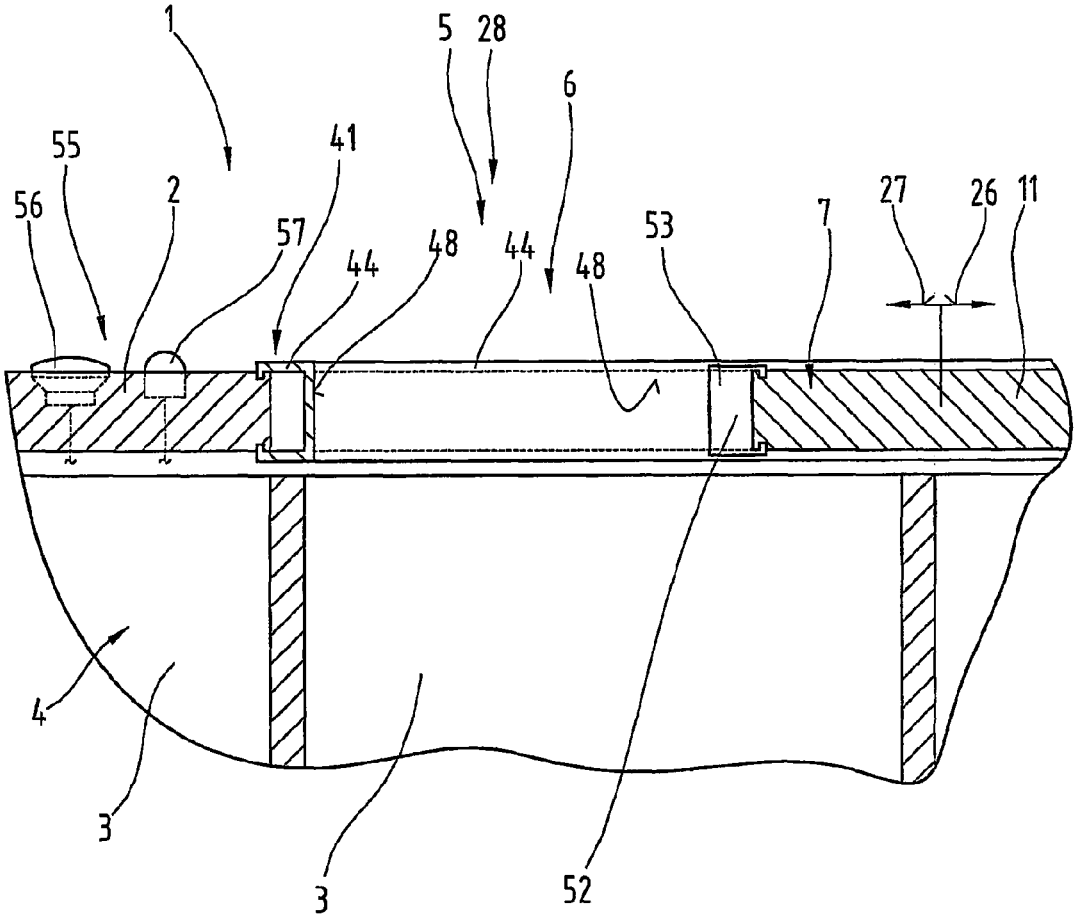
FIG. 7 shows a part-region of the storage machine illustrated in FIG. 6, viewed in section along line VII-VII indicated FIG. 6 in conjunction with other safety features.

As may be seen from FIGS. 6 and 7, elastic blanking or cover elements 49 may be provided in order to increase the safety of the storage machine 1 for persons. Such blanking or cover elements 49, which are preferably of an elastic and optionally also of a labyrinth-type design, are preferably disposed in gaps 50 between the closure mechanism 7, in particular the slides 11, and the machine housing 2. Alternatively or in combination with this, gaps 51 between the individual slide elements 11 disposed one above the other may also be provided with such elastic blanking or cover elements 49. These blanking or cover elements 49 prevent items of clothing or parts of limbs from being drawn into and trapped in the gaps 50; 51, because these blanking or cover elements 49 fill or cover the gaps 50; 51 as far as possible. Especially if these blanking or cover elements 49 cover the gaps 50; 51 in a labyrinth-type arrangement, a situation in which items of clothing or body parts can be drawn in due to moving slide elements 11 is virtually ruled out.

It may also be of practical advantage to provide a deflector element 52 in the form of an elastic sealing lip on the closure mechanism 7 provided in the form of at least one linearly displaceable slide element 11. This being the case, this deflector element 52 lies on at least one boundary surface 48 of the compartment opening and is secured to the slide element 11 so that it is able to slide on the at least one boundary surface 48 when the slide element 11 is moved by means of the co-operating drive. This also prevents items of clothing or body parts from being drawn in and trapped because the deflector element 52 deflects objects in the displacement region of the slide element 11 and prevents them from being drawn into gaps or spaces between moving and non-moving parts. It is of advantage if a deflector lip 53 of the deflector elements 52 subtends an obtuse angle 54 between boundary surfaces 48 of the compartment opening extending at a right angle to one another.

As illustrated in FIG. 7, in one advantageous embodiment, the storage machine 1 may have at least one optical and/or acoustic signaling element 55, designed to output an optical and/or acoustic warning signal. Such a warning signal is emitted by the optical and/or acoustic signaling element 55 immediately prior to the start of and/or during the automated movement of the closure mechanism 7, in particular the at least one slide element 11. As a result, the user of the storage machine 1 is alerted to the fact that an automatic movement is about to take place or be initiated beforehand and in plenty of time, so that he is ready for it and can take precautionary measures if necessary. This avoids a user of the storage machine 1 being startled by such an acoustic or optical signal due to a sudden movement of the machine. As illustrated in FIG. 7, such a signaling element 55 may be provided in the form of a loudspeaker 56 and/or a lamp means 57 connected to the control system 14—see FIG. 4 for example.

FIG. 7 illustrates another embodiment of an elastic buffer element 44 forming the boundary surfaces 48 of the compartment opening in order to reduce the risk of injury to persons.

The preferred design of the storage machine 1 has a closure mechanism 7 in the form of at least two slide elements 11 disposed one above the other which can be moved separately from one another, as illustrated in FIG. 6, for example. These slide elements 11, which can be activated and thus moved separately from one another, are used to control access to the compartments 3 of the compartment system 4 lying behind the slide elements 11 by reference to the access direction of a person, as may be seen by comparing FIG. 7 and FIG. 8 with FIG. 1.

Figure 8:
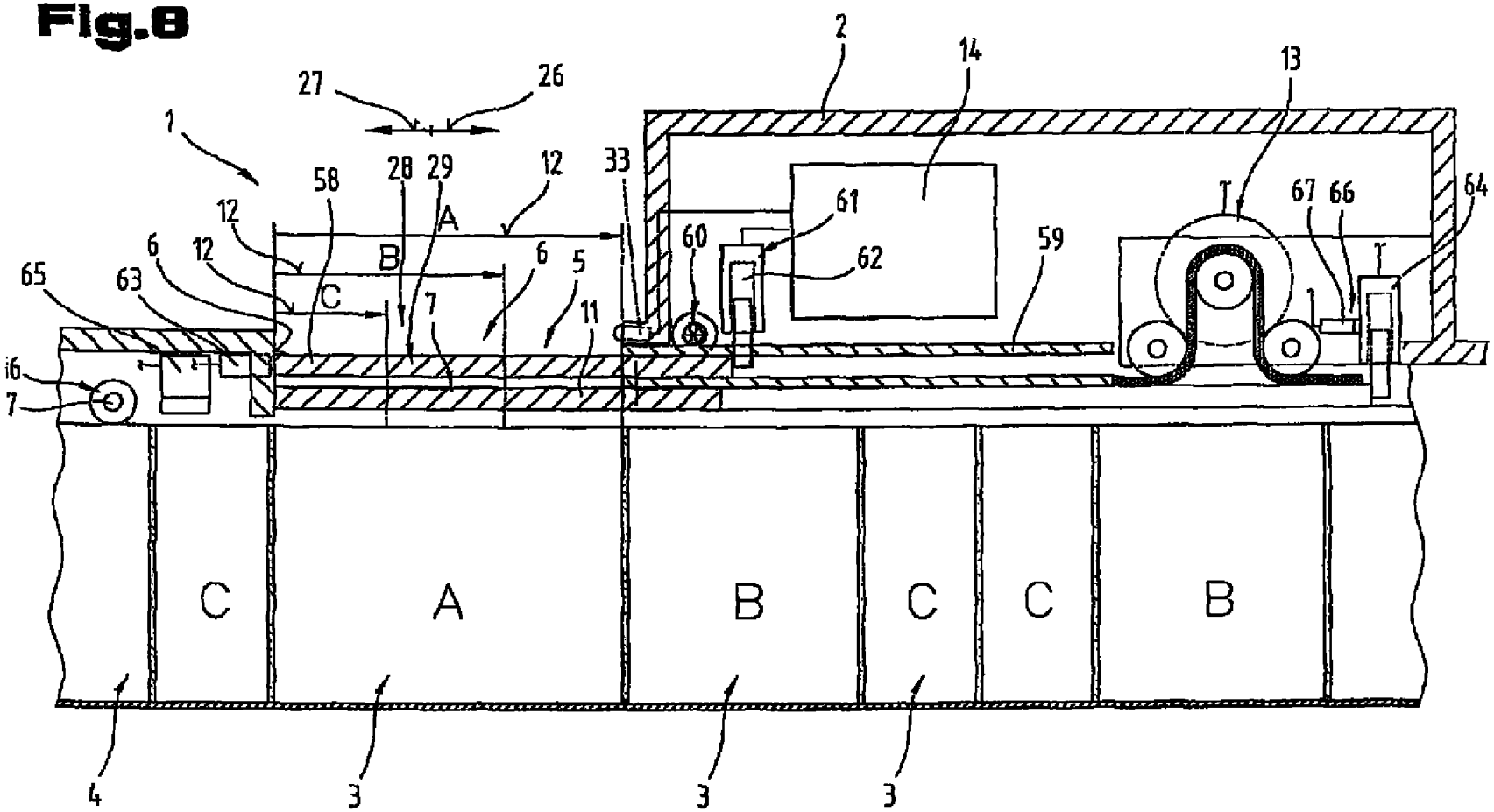
FIG. 8 is a schematic diagram showing a simplified section of a storage machine with additional safety features.

As may be seen from another embodiment of the storage machine 1 illustrated in FIG. 8, at least one protective door 58 covering several slide elements 11 or the entire central access orifice 6 may be provided upstream of the slide elements 11. This protective door 58, which is disposed in front of the automatically displaceable slide elements 11 by reference to the access direction to the compartments 3 is used to cover or protect access to the automatically displaceable slide elements 11. This protective door 58 may be mounted so that it is able to pivot about a vertical pivot axis, as shown in the embodiment illustrated in FIG. 4. Alternatively, this protective door 58 may be provided in the form of a sliding door in front of the individual slide elements 11 or in front of or directly in the access orifice 6 of the machine housing 2 and is preferably mounted so that it is able to slide in the horizontal direction, as is the case with the embodiment illustrated in FIG. 8. To enable it to move in the horizontal direction or within a vertical plane, the protective door 58 is provided with at least one guide mechanism 59 by means of which the board-shaped protective door 58 is mounted in the form of a sliding door.

The protective door 58 may also co-operate with a drive system 60 with a limited speed and/or force to enable an automatic movement or displacement of the protective door 58. Alternatively, the protective door 58 may also be manually displaceable. When the protective door 58 is in the fully closed position—as illustrated in the diagram of FIG. 8—the slide elements 11 and the compartment system 4 overlap with one another as completely as possible and thus prevent access.

Especially if the protective door 58 co-operates with a drive system 60 with a limited speed and/or force, as is the case in a preferred embodiment, a tumbler 61 is provided which can be mechanically deactivated on a controlled basis, which prevents the protective door 58 from being opened automatically or manually—starting from the fully closed position of the protective door 58—when the tumbler 61 is active. This tumbler 61 may be provided in the form of an electromagnetically displaceable lock mechanism 62, as schematically indicated in FIG. 8. The tumbler 61 or the electromagnetic lock mechanism 62 can be controlled or activated by the control system 14 so as to automatically lock or release the protective door 58. When the tumbler 61 is in the active state, i.e. in the state in which the protective door 58 is locked, the protective door 58 is reliably prevented from being opened from the fully closed position illustrated in FIG. 8 in the opening direction—indicated by arrow 26. The tumbler 61 is preferably deactivated by means of an appropriate active control signal emitted by the electronic control system 14. In other words, it is only when the tumbler 61 is in the non-active state that the protective door 58 can be moved in the opening direction—indicated by arrow 26. The tumbler 61 is preferably active in the state when it is not receiving power and the tumbler 61 can be switched to a deactivated state by applying power, preferably electric power, or optionally pneumatic driving power, so that the protective door 58 can be moved in the opening direction—indicated by arrow 26—manually and/or by means of the respective co-operating drive system 60.

In one advantageous embodiment, the protective door 58 may be provided with a control mechanism 63 incorporating sensors. This sensor-operated control mechanism 63 is actively connected to the control system 14 or to at least one of the drives which poses a potential risk. This sensor-based control mechanism 63 is used to detect the closed or open status of the protective door 58. In the situation where the control mechanism 63 detects that the protective door 58 is open or partially open, an automated movement of the slide elements 11 or the compartment system 4 is prevented via the control system 14 or by directly acting on a switch element to rule out any risk to persons. The sensor-operated control mechanism 63 may be provided in the form of electric switch elements or in the form of sensors operating on any other physical principle which transmit representative message signals to the control system 14 depending on the closed or open status of the protective door 58 and act in an appropriate manner on switching mechanisms for the drive system 13 or on switch mechanisms for the drive unit 17.

Providing a protective door 58 in front of the slide elements 11 also permits an advantageous operating mode of the storage machine 1. In particular, to enable objects to be deposited in the storage machine 1, several compartments 3 or several compartment openings are released by several slide elements 11. During an automatic displacement of the compartment system 4 or compartments 3, the latter may be covered solely by the protective door 58 and secured against access to prevent injury due to a moving compartment system 4 when the compartment system 4 is being automatically moved by the drive unit 17 in order to position specific compartments 3.

An active sensor-based monitoring system 29—of the type described above—may also be used to protect a person during the operation of depositing objects whilst the compartment system 4 is being moved when compartments 3 are open or slide elements 4 are open. Especially if the machine is being used by delivery service operators aware of the risks, an adequate security level can be achieved by the monitoring system 29, even though it would be possible to grip or come into contact with the moving compartment system 4 due to an at least partially open closure mechanism 7. In particular, it is possible to switch off and/or brake the compartment system 4 immediately via the monitoring system 29 if a delivery service operator who is trained or is aware of the risk moves into the defined monitoring range of the monitoring system 29. As a result, especially in the case of bulk dispatches, a delivery service operator who is trained or aware of the risks posed by the storage machine 1 can deposit objects relatively quickly. The monitoring system 29 for automatically switching off or braking a moving compartment system 4 therefore increases operating safety for the trained operator delivering objects. In particular, if a dangerous state occurs or if an object is detected in the monitoring and danger zone of the storage machine 1 monitored by sensors. the drives 13 and/or 17 posing potential risks can be automatically switched off.

With the embodiment illustrated in FIG. 8, it is also possible to use a photoelectric barrier system 33 as an alternative to or in combination with the protective door 58, which operates on the reflection principle, as schematically indicated in the region of the access orifice 6.

In combination with at least one embodiment of the monitoring systems 29 proposed above, it is possible to provide the drive systems 13 for the closure mechanism 7 in the form of individual slide elements 11 by means of a frictionally retained drive. The main reason for this is that there is barely any risk of injury to the user at all as a result of the safety system 28 and the sensor-based monitoring systems 29 described above. Using frictionally retained drive systems 13 for the slide elements 11 advantageously increases security in terms of attempts to break in or gain unauthorized access to compartments 3 to which access is intended to be denied, disposed next to the specific compartment 3. Such an access control system can be easily set up by using frictionally retained drive systems 13 for the slide elements 11, which are reliable and inexpensive. By frictionally retained drives are meant worm gear drives, brake motors and similar, for example. In particular, a frictionally retained drive system 13 remains in the stationary position or respective stopped position if the motion-imparting energy is switched off with a sufficiently high retaining or braking force, even if the mechanical components of the slide element 11 are subjected to external forces, in particular manual pushing forces.

In one advantageous embodiment, every plate-shaped slide element 11 of the storage machine 1 may co-operate with an electromechanical lock element 64 which can be selectively released on a controlled basis, as illustrated in FIG. 8 for example. When the locked state is assumed, this lock element 64 prevents the respective slide elements 11 from being opened or pushed from the fully closed position of the respective slide element 11. Particularly if the lock element 64 is active, the slide element co-operating with this automatically controllable slide element 11 is reliably prevented from being opened or forced. This ensures that no access can be gained to a compartment system 4 which might be moving behind the slide element 11 and compartments 3 are protected against unauthorized access with a high degree of security.

The storage machine 1 may also have a motion monitoring system 65 for a compartment system 4 which is mounted so as to be relatively displaceable. The purpose of this electrical or sensor-based motion monitoring system 65 is to detect by sensor any movements of the compartment system 4 or its drive unit 17. This being the case, the motion monitoring system 65 comprises at least one sensor, which may detect any movements or stoppages of components, in particular the compartment system 4 or its drive unit 17, on the basis of any physical principle. The motion monitoring system 65 is functionally coupled with the control system 14 and/or with the separate evaluation unit and/or with at least one lock element 64 for the slide elements 11—as schematically indicated. In particular, an electromechanically releasable lock element 64 for a slide element 11 can not be released unless a release signal is issued by the control system 14 and a release signal is simultaneously also emitted by the motion monitoring system 65. This ensures that the compartment system 4 can not be accessed unless it is stationary. Otherwise, the motion monitoring system 65 prevents a slide element 11 from being opened due to the active lock element 64, affording a high degree of security.

In order to increase processing or functional reliability, the electromechanically releasable lock elements 64 for the slide elements 11 may co-operate with electric or sensor-operated control mechanisms 66. Such a control mechanism 66 might be a simple electric control contact or a control sensor 67. The control mechanism 66 is designed so that it issues an active release signal for a drive system 13 of the compartment system 4 only if the slide elements 11 are in the fully closed position and locked by means of the lock elements 64. It may be expedient if the control mechanisms 66 or the control outputs of several lock elements 64 for several slide elements 11 are connected or linked so that the drive unit 17 can not be activated in order to produce a relative displacement of the compartment system 4 unless all the slide elements 11 are closed and are also definitively locked in their closed position. This results in a high-level, automatically operating and highly reliable machine control system.

Figure 9:
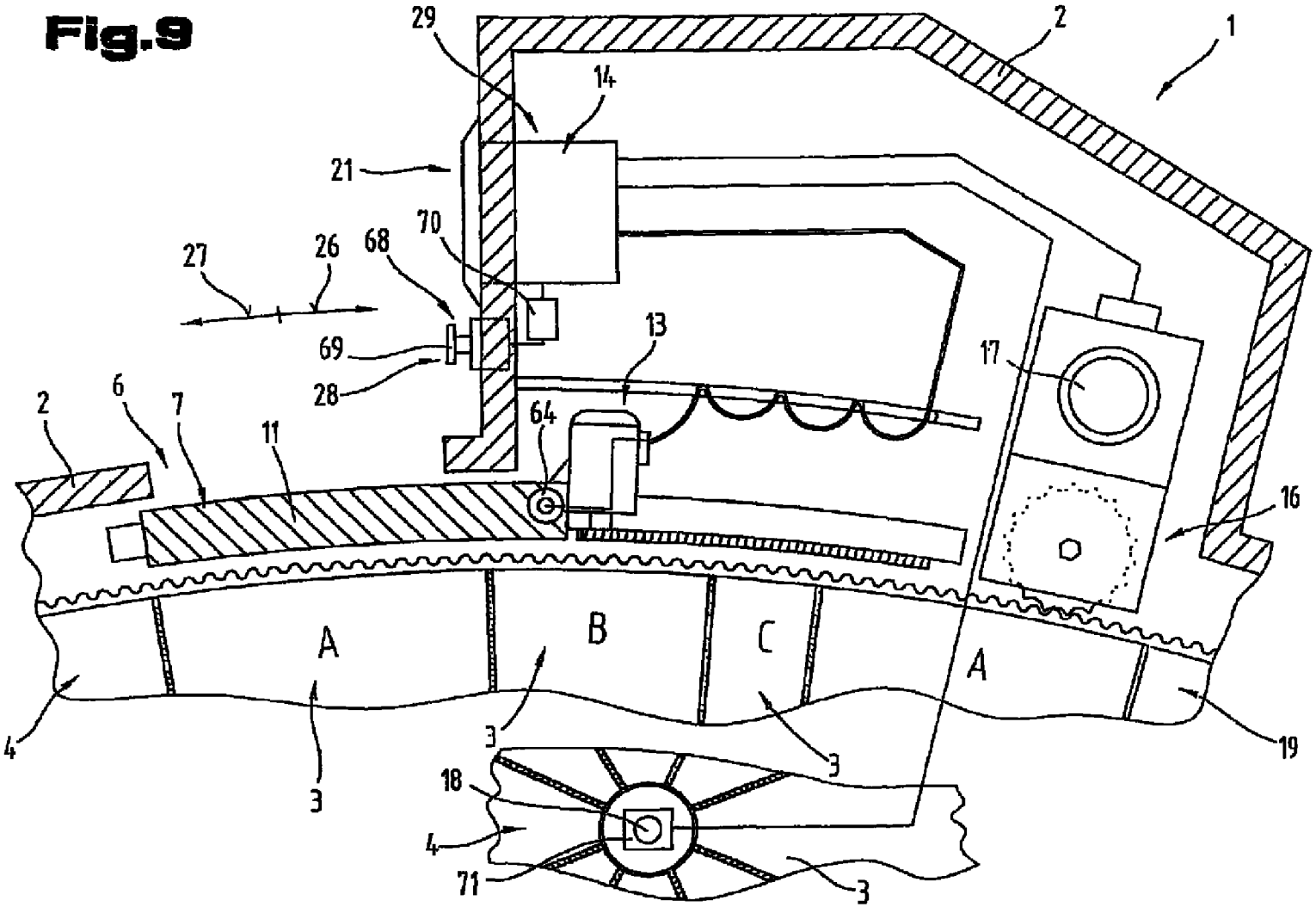
FIG. 9 is a highly simplified, symbolic diagram showing another embodiment of a storage machine with a security system for increasing the safety of persons.

The embodiment illustrated in FIG. 9 shows another storage machine 1 with a safety system 28 for increasing personal safety. In this case, the storage machine 1 has a safety switch system 68 which must be manually operated by the user, as schematically illustrated in FIG. 9. This safety switch system 68 must be activated by the user when a closing operation and/or an opening operation of the closure mechanism 7, in particular the at least one slide element 11, must be run by means of the co-operating drive system 13. This safety switch system 68 is preferably of a design conforming to current stands in security technology and is preferably provided in the form of a so-called security button 69. A safety switch system 68 of this type conforms to higher technical requirements in terms of reliability. Above all, a safety switch system 68 comprising a security button 69 may also be referred to as a so-called OK button, which does not emit a release or OK signal unless operated in a specific way, especially in order to effect an automated closing movement and/or in order to effect an opening movement of the closure mechanism 7. To this end, the safety switch system 68 is connected to the control system 14 and/or is switched into the power supply system for the drive system 13 to be secured by the security system—as schematically indicated.

It is of advantage if this safety switch system 68 is mounted at a height that is safe for children. In other words, the safety switch system 68 is positioned so that it can not be reached by children, who might not correctly or fully realize the risks which the machine can pose under certain circumstances. Accordingly, the safety switch system 68 is preferably mounted or fitted on the machine housing 2 at a height of more than 1 m, preferably more than 1.5 m, above a standing plane 31 (FIG. 1) of the machine. This ensures that small children aged up to approximately 6 years can not reach the safety switch system 68 in order to initiate movements which might pose risks, or can do so only with great difficulty.

The safety switch system 68 is integrated with the control system 14 and in the control procedures of the storage machine 1 so that the driving power for the drive system 13 of the closure mechanism 7 and/or for the drive unit 17 of the compartment system 4 can not be released or switched unless the safety switch system 68 has been manually activated or operated. This firstly ensures that no machine movements or potentially risky actions can be initiated other than by a user deliberately activating the drives which pose potential risks. In particular, when the user activates the safety switch system 68, he is aware that a movement of the closure mechanism 7 or the compartment system 4 of the machine via die drive system 13 or the drive unit 17 is about to happen or take place.

In one advantageous embodiment, the safety switch system 68 is designed to start a timer switch element 70 with a predefined release time for the closing and/or opening operation of the closure mechanism 7. The release time of this timer switch element 70 is timed to be less than 1 min and on expiry of this release time, power is cut off from the drive system 13 for the closure mechanism 7 and/or the drive unit 17 for the compartment system 4. This prevents a closing or opening operation from taking place when the user is not looking.

For practical purposes, the closure mechanism 7, in particular the respective slide element 11, remains open if the safety switch system 68 has not been operated by the user of the machine. It is also of advantage if an open compartment of the compartment system 4 has to be closed by a user of the storage machine 1 first before the actual depositing or removal operation can take place. These features reduce the likelihood of children playing near the machine and being accidentally trapped and prevents animals from climbing into the compartments 3 of the storage machine 1.

Even better functional safety can be achieved if the safety switch system 68 or an electromechanical release system is provided with additional safety circuits or switch elements for the driving power, which operate or act independently of the actual control system 14 of the storage machine 1. As a result, any fault in the control sequence of the control system 14, for example the occurrence of an unforeseen special operating state, can not lead to a loss of security.

In another embodiment offering high functional reliability, the timer switch element 70 is of a design based on security technology. A predefined release period of the timer switch element 70 corresponds to the time it usually takes for the closure mechanism 7 to move into the fully closed position with the slide element 11 in a specific open position. When this release time predefined by the machine design or the respective open positions of the various slide elements 11 has elapsed, a closure mechanism 7 which has not reached the closed position can no longer be automatically moved into the closed position. Instead, the closure mechanism 7 must be moved into the closed position manually and the timer switch element 70 has to be set again by operating the safety switch system 68 in order for the user to initiate an intentional full closing operation.

It may also be of practical advantage if the lock element 64 for a slide element 11 that is in the closed position can not be activated unless the release time for the driving power of the slide element 11 is still running or active. This also prevents children or living beings from being accidentally locked in and prevents them from being inadvertently locked in the compartment system 4 of the storage machine 1 because the lock elements 64 for the respective slide elements 11, which are tamper-proof or can not be forced, can not be activated unless the limited release time is still running. This means that when the release time has elapsed, a slide element 11 is not automatically locked by the machine but is specifically prevented.

Alternatively, it would also be possible to permit a closing operation of the closure mechanism 7 or an open slide element 11 only in the presence of a valid means of identification, such as a magnetic and/or chip card or some other means of identification, which is inserted in and read by an identification and/or authorization checking means 24, which also prevents children from being locked in the storage machine 1 or endangered due to dangerous games. This identification and/or authorization checking means 24 can also easily be used as a means of recording and subsequently checking when and by which user a closing operation of the storage machine 1 was initiated or authorized.

As part of the security sequence of the storage machine 1, it may be that an automatic closing movement of the closure mechanism 7 or the at least one slide element 11 is permitted only within a certain time after a user's identification has been successfully checked, for example by magnetic or chip card.

In order to increase the safety of the storage machine 1 with respect to endangering persons, an electronic detection system 71 may be provided for determining the current weight of the total compartment system 4 and/or individual compartments 3. This electronic detection system 71 means that it is possible to check on an automated basis whether, following a removal operation initiated by a user, the weight of the compartment system 4 has risen noticeably or significantly and then block a closing operation of the storage machine 1 because following a removal, the weight of the compartment system 4 should decrease or can at least remain the same if the object was not removed for whatever reason. However, the weight of the compartment system 4 should under no circumstances be higher than before after a removal operation, since this would lead to the conclusion that something has been deposited without authorization or this weight increase is due to a child or a living being creeping into the compartment system 4 unobserved. In the case of an atypical increase in weight, which can be detected by the detection system 71, at least an automatic closing operation of the closure mechanism 7 or the respective slide element 11 is not run.

In order to check or detect changes in weight, the total weight of the compartment system 4 or the weight of at least individual compartments 3 can be determined on a cyclical basis and the respective values stored as measurement results. This measuring routine relating to the weights of the storage machine 1 also enables conclusions to be drawn about the actual deposit and removal operations taking place at the storage machine 1.

An automatic closing operation of the closure mechanism 7 or the slide elements 11 is expediently effected only if the weight of the compartment system 4 or the respective compartment 3 is not higher or only negligibly higher than the weight of the compartment system 4 or the respective compartment 3 before the removal operation initiated by the user. A closing operation of the closure mechanism 7 or the co-operating slide element 11 may optionally also be triggered automatically when a weight reduction is detected. This increases operating convenience and the machine sequences are automated to a high degree as a result.

The detection system 71 for determining the weight of the compartment system 4 or individual compartments 3 may also be used as a means of preventing overloading or excessive strain. In particular, this detection system 71 or the control system 14 connected to the detection system 71 may prevent further deposits or the depositing of an excessively heavy object. This maintains high personal safety and also the functional reliability of the storage machine 1.

The detection system 71 may also be used for detecting an increase in weight or a decrease in weight, in order to obtain the most uniform possible weight distribution for the compartment system 4. In particular, via the control system 14 in conjunction with the detection system 71, it is possible to prevent an individual shelf portion from being too heavily loaded and only relatively light objects being placed in an adjacent or oppositely lying portion. In particular, the control system 14 or detection system 71 may designed or programmed to obtain the most homogeneous possible weight distribution in the displaceable, preferably rotatable, compartment system 4 and prevent heavy loads on one side.

Alternatively or in combination with this, the detection system 71 may also be used for determining the weight or load status of the compartment system 4 or individual compartments 3 as well as for detecting or sensing attempts to break into or break open the storage machine 1. As a result, a multi-functional detection system 71 is provided, which has a plurality of combined effects and advantageous uses.

The embodiments illustrated as examples represent possible design variants of the storage machine 1 and safety system 28 and it should be pointed out at this stage that the invention is not specifically limited to the design variants specifically illustrated, and instead the individual design variants may be used in different combinations with one another.

For the sake of good order, finally, it should be pointed out that, in order to provide a clearer understanding of the structure of the storage machine 1, it and its constituent parts are illustrated to a certain extent out of scale and/or on an enlarged scale and/or on a reduced scale.

Above all, the individual embodiments of the subject matter illustrated in FIGS. 1, 2; 3; 4; 5; 6, 7; 8; 9 constitute independent solutions proposed by the invention in their own right. The objectives and associated solutions proposed by the invention may be found in the detailed descriptions of these drawings.

List of reference numbers

| | |
|---|---|
| 1 | Storage machine |
| 2 | Machine housing |

-continued

| List of reference numbers | |
|---|---|
| 3 | Compartment |
| 4 | Compartment system |
| 5 | Access mechanism |
| 6 | Access orifice |
| 7 | Closure mechanism |
| 8 | Width |
| 9 | Compartment width |
| 10 | Height |
| 11 | Slide element |
| 12 | Opening width |
| 13 | Drive system |
| 14 | Control system |
| 15 | Individual access orifice |
| 16 | Transport mechanism |
| 17 | Drive unit |
| 18 | Axis |
| 19 | Round magazine |
| 20 | Rotary drive |
| 21 | User interface |
| 22 | Terminal |
| 23 | Input- and/or output means |
| 24 | Identification and/or authorization checking means |
| 25 | Scanner |
| 26 | Arrow |
| 27 | Arrow |
| 28 | Safety system |
| 29 | Monitoring system |
| 30 | Camera arrangement |
| 31 | Standing plane |
| 32 | Line |
| 33 | Photoelectric barrier system |
| 34 | Light screen |
| 35 | Light transmitting element |
| 36 | Light receiving element |
| 37 | Boundary surface |
| 38 | Boundary surface |
| 39 | Transmitter and/or receiver system |
| 40 | Infrared detector |
| 41 | Stop or contact bar |
| 42 | Abutment edge |
| 43 | Abutment edge |
| 44 | Buffer element |
| 45 | Closing edge |
| 46 | Radius |
| 47 | Minimum thickness |
| 48 | Boundary surface |
| 49 | Blanking or cover element |
| 50 | Gap |
| 51 | Gap |
| 52 | Deflector element |
| 53 | Deflector lip |
| 54 | Angle |
| 55 | Optical and/or acoustic signaling element |
| 56 | Loudspeaker |
| 57 | Lamp means |
| 58 | Protective door |
| 59 | Guide mechanism |
| 60 | Drive system |
| 61 | Tumbler |
| 62 | Lock mechanism |
| 63 | Control mechanism |
| 64 | Lock element |
| 65 | Motion monitoring system |
| 66 | Control mechanism |
| 67 | Control sensor |
| 68 | Safety switch system |
| 69 | Security button |
| 70 | Timer switch element |
| 71 | Detection system |

The invention claimed is:

1. A storage machine for objects comprising:

(a) a compartment system comprising a plurality of compartments and at least one closure mechanism;

(b) a machine housing at least partially enclosing said compartments, said machine housing comprising a central predefined access orifice;

(c) at least one drive system for effecting a controlled displacement of the at least one closure mechanism;

(d) a control system; and (e) at least one safety system to ensure extensive, increased personal safety with respect to risks posed by automated sequences and with respect to automatically activatable moving devices;

wherein said at least one closure mechanism is displaceable relative to the central predefined access orifice in order to permit or prevent access to a specific, individual compartment or to a specific group of adjacent compartments;

wherein the ability of the at least one closure mechanism to move depends on an access right verifiable by the control system;

wherein the at least one safety system comprises a safety switch system having a manually operated security button for producing at least one automatically driven movement of the at least one closure mechanism selected from the group consisting of a closing movement and an opening movement, and a timer switch element with a predefined release time for starting at least one operation of the at least one closure mechanism selected from the group consisting of a closing operation and an opening operation so that a limited time is set for effecting the closing movement, wherein the at least one closure mechanism cannot be automatically directly closed other than if deliberately released and supervised by a user.

2. The storage machine according to claim 1, wherein the at least one safety switch system is mounted at a location out of a child's reach.

3. The storage machine according to claim 2, wherein the at least one safety switch system is mounted on the machine housing more than 1 m above a standing plane of the machine.

4. The storage machine as claimed in claim 1, wherein the compartment system comprises a drive unit and driving power for at least one of the at least one drive system and the drive unit is released or connected by the at least one safety switch system.

5. The storage machine as claimed in claim 1, wherein the compartment system comprises a drive unit and when the release time has elapsed, power to at least one of the at least one drive system and the drive unit is switched off.

6. The storage machine as claimed in claim 1, wherein the at least one closure mechanism comprises a slide element and if the safety switch system is not operated, the slide element is left open and is not automatically closed.

7. The storage machine according to claim 1, wherein an open compartment of the compartment system must be closed by the user before a deposit or removal can be made.

8. The storage machine according to claim 1, wherein the safety switch system or a release switch system for driving power of the at least one drive system comprises additional safety circuits or switch elements operating independently of the control system.

9. The storage machine according to claim 1, wherein the release time of the timer switch element corresponds to a time the at least one closure mechanism usually takes to fully close and when the release time elapses, the at least one closure mechanism is no longer automatically movable into a closed position.

10. The storage machine according to claim 1, wherein the at least one closure mechanism has a closed position and a lock element activatable exclusively during the release time when power is applied to the at least one closure mechanism.

11. Storage machine according to claim 1, wherein a closing operation of the closure mechanism can not take place except in the presence of a valid means of identification such as a magnetic and/or a chip card, which can be inserted in and read by an identification and/or authorization checking means of the machine.

12. Storage machine according to claim 11, wherein an automated closing movement is possible only within a certain period once a user has been successfully identified.

13. Storage machine according to claim 1, wherein at least one monitoring system is provided for monitoring an area in front of the compartment opening of at least one compartment.

14. Storage machine according to claim 13, wherein the monitoring system has at least one camera arrangement.

15. Storage machine according to claim 1, wherein at least one monitoring system is provided for monitoring a reaching-in area through a compartment opening of at least one compartment.

16. Storage machine according to claim 1, wherein the monitoring system has at least one transmitter and/or receiver system for infrared light or for ultrasound.

17. Storage machine according to claim 1, wherein the monitoring system is connected to a central control system of the storage machine or to a control system for the at least one closure mechanism, in particular is coupled with the at least one drive system for control purposes.

18. Storage machine according to claim 1, wherein the monitoring system is provided with at least one photoelectric barrier system, a light screen or a light curtain in front of a compartment opening or in front of the central access orifice in the access direction.

19. Storage machine according to claim 18, wherein the monitoring system has light transmitting and light receiving elements, in particular for infrared light, which are disposed on non-displaceable or non-moved components or portions of the machine housing.

20. The storage machine according to claim 1, wherein the machine housing comprises a compartment opening, wherein the at least one closure mechanism comprises a front end portion, a front closing edge, and a housing-side abutment edge bounding the compartment opening, and wherein a stop or contact bar is provided on the front end portion or in a front portion lying adjacent to the front closing edge by reference to a closing direction and/or on the housing-side abutment edge.

21. Storage machine according to claim 1, wherein the monitoring system (29) or a stop or contact bar (41) prevents or interrupts a closing operation if an obstacle is detected in the monitoring or danger area, or emits a signal in order to re-open the closure mechanism (7).

22. The storage machine according to claim 1, wherein at least one of the machine housing and the at least one closure mechanism (7) comprises an abutment edge having an elastically flexible and rebounding buffer element.

23. The storage machine according to claim 1, wherein at least one of the machine housing and the at least one closure mechanism comprises user-grippable closing edges having radii of more than 2 mm.

24. The storage machine according to claim 1, wherein the at least one closure mechanism comprises at least one linearly displaceable slide element having a minimum depth or minimum thickness of approximately 15 mm at least in a front end portion by reference to a closing direction.

25. The storage machine according to claim 24, wherein the at least one linearly displaceable slide element comprises an elastic deflector lip and lies against at least one boundary surface of a compartment opening in a sliding arrangement.

26. The storage machine according to claim 25, wherein the deflector lip forms or subtends an obtuse angle between boundary surfaces of the compartment opening extending at right angles to one another.

27. The storage machine according to claim 1, wherein the at least one closure mechanism comprises at least one slide element lying flush with a boundary surface of the machine housing in a closed state.

28. The storage machine according to claim 27, further comprising a plurality of gaps between the at least one slide element and the machine housing, said gaps being provided with elastically flexible and rebounding blanking or cover elements.

29. The storage machine according to claim 27, further comprising a plurality of gaps between individual slide elements disposed one above the other, said gaps being provided with elastically flexible and rebounding blanking or cover elements.

30. The storage machine according to claim 27, further comprising a plurality of gaps between the at least one slide element and the machine housing and between individual slide elements disposed one above the other, said gaps being provided with elastically flexible and rebounding blanking or cover elements.

31. Storage machine according to claim 1, wherein an optical and/or acoustic signaling element is provided as a means of emitting an optical and/or acoustic warning signal directly before the start of and/or during an automated movement of the closure mechanism, in particular the at least one slide element.

32. The storage machine according to claim 1, wherein the at least one closure mechanism has at least two slide elements disposed one above the other and displaceable separately from one another for controlling or regulating access to the compartments of the compartment system lying behind.

33. The storage machine according to claim 32, wherein at least one protective door covering several slide elements is disposed in front of the at least two slide elements or the central access orifice is entirely disposed in front of the at least two slide elements.

34. The storage machine according to claim 33, wherein the at least one protective door comprises a drive system of at least one of limited speed and limited force for automatically displacing the protective door.

35. The storage machine according to claim 33, wherein the protective door is provided with a tumbler deactivatable by the control system.

36. The storage machine according to claim 33, wherein the protective door is provided with a control mechanism for reliably determining the closed/open status of the protective door.

37. The storage machine according to claim 33, wherein several compartments or several compartment openings are released by the slide elements for depositing objects and during an automatic displacement of the compartment system are covered or secured against access by only the protective door or are protected or blocked off by an active sensor-based monitoring system to prevent contact during a movement of the compartment system.

38. The storage machine according to claim 32, wherein the slide elements have drive systems comprising frictionally retained drives.

39. The storage machine according to claim 32, wherein each slide element is provided with a respective controllably-releasable electromechanical lock element.

40. The storage machine machine according to claim 39, wherein each lock element cannot be released unless a release signal is emitted by the control system and a release signal is simultaneously emitted by a motion monitoring system for the compartment system or a drive unit of the compartment system.

41. The storage machine machine according to claim 39, wherein each lock element has an electric control mechanism wherein the control mechanism does not emit an active release signal for supplying power to a drive unit of the compartment system unless the slide element is fully closed and locked by the lock element.

42. The storage machine machine according to claim 41, wherein the control mechanisms or control outputs of several lock elements for the slide elements are switched or linked so that a drive unit can only be activated for a relative displacement of the compartment system if all the slide elements are closed and locked in their closed position.

43. Storage machine according to claim 1, wherein an electronic detection system is provided for determining the current weight of the entire compartment system and/or individual compartments.

44. Storage machine according to claim 43, wherein the total weight of the compartment system or the weight of at least individual compartments is determined cyclically or as a function of events and the respective values are stored as measurement results.

45. Storage machine according to claim 43, wherein the detection system or one connected to the control system checks whether the total weight of the compartment system or the weight of the relevant compartment has reduced or remains the same after a deposit or removal operation or whether an increase in weight has occurred.

46. Storage machine according to claim 45, wherein an automated closing operation of the closure mechanism takes place only if the determined weight is not higher or is only negligibly higher than the weight prior to the removal.

47. Storage machine according to claim 45, wherein a closing operation is automatically triggered when a reduction in weight is detected.

48. Storage machine according to claim 43, wherein the detection system is designed to prevent overloading or excessive strain.

49. Storage machine according to claim 43, wherein the detection system is provided as a means of detecting or sensing attempts to break into or break open the machine.

* * * * *